US006683593B2

(12) United States Patent
Miyatake et al.

(10) Patent No.: US 6,683,593 B2
(45) Date of Patent: Jan. 27, 2004

(54) LIQUID CRYSTAL DISPLAY

(75) Inventors: Masaki Miyatake, Saitama-ken (JP); Yasuyuki Hanazawa, Saitama-ken (JP); Hiroyuki Sakurai, Saitama-ken (JP); Masakatsu Kitani, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 339 days.

(21) Appl. No.: 09/788,638

(22) Filed: Feb. 21, 2001

(65) Prior Publication Data

US 2001/0015713 A1 Aug. 23, 2001

(30) Foreign Application Priority Data

Feb. 22, 2000 (JP) ..... P2000-044299
Feb. 29, 2000 (JP) ..... P2000-053914

(51) Int. Cl.[7] ..... G09G 3/36
(52) U.S. Cl. ..... 345/92; 345/87; 345/98
(58) Field of Search ..... 345/92, 93, 98, 345/87, 103, 38, 99, 205; 349/38

(56) References Cited

U.S. PATENT DOCUMENTS 5,321,535 A * 6/1994 Ukai et al. ..... 349/85
5,408,252 A * 4/1995 Oki et al. ..... 345/205
5,506,598 A * 4/1996 Shimada et al. ..... 345/92
6,049,321 A * 4/2000 Sasaki ..... 345/99
6,088,071 A * 7/2000 Yamamoto et al. ..... 349/38
6,437,367 B1 * 8/2002 Yamazaki et al. ..... 257/59

* cited by examiner

*Primary Examiner*—Steven Saras
*Assistant Examiner*—Fritz Alphonse
(74) *Attorney, Agent, or Firm*—Oblon, Spivak, McClelland, Maier & Neustadt, P.C.

(57) ABSTRACT

A liquid crystal display realizes high resolution without enlarging a frame area of an array substrate in the display. The display connects analog switch pairs each consisting of a p-TFT and an n-TFT to signal lines, respectively. Among the TFTs, those having the same polarity and connected to adjacent signal lines are provided with drain electrodes that are connected to a video bus through a common contact hole. Sharing the contact holes among the TFTs enables the switch pairs to be juxtaposed at fine pixel pitches.

8 Claims, 21 Drawing Sheets

LIQUID CRYSTAL DISPLAY

CROSS REFERENCE TO RELATED APPLICATIONS

This application is based on and claims benefit of priority from the prior Japanese Patent Applications No. 2000-044299 filed Feb. 22, 2000 and No. 2000-53914 filed Feb. 29, 2000, the entire contents of which are incorporated herein by reference.

BACKGROUND OF THE INVENTION

1. Field of the Invention

The present invention relates to a liquid crystal display (LCD) having a matrix of signal and scan lines on a principal plane of a substrate, pixel switching elements formed at the intersections of the signal and scan lines, respectively, and drivers integrally formed on the periphery of the principal plane of the substrate, to supply signal voltages.

2. Description of the Related Art

Recent flat displays, typically LCDs, are thin, light, and low power consumption, and therefore, are used for various appliances. Among LCDs, TFT-LCDs (thin-film transistor LCDs) are active matrix LCDs having pixel matrixes and TFTs serving as pixel switching elements. The TFT-LCDs provide clear images at high resolution that is comparable or superior to that of CRTs, and therefore, are used for applications that need high resolution.

Recent TFT-LCDs have drivers within them, to expand an effective display area on a transparent insulating substrate (hereinafter referred to as "array substrate") and reduce manufacturing costs. This type of TFT-LCD has a scan driver for supplying scan signals to pixel switching elements through scan lines, and a signal driver for supplying video signals to the pixel switching elements through signal lines. These drivers are integrated on an array substrate on which display pixels are formed. TFT-LCDs now being developed have sample-and-hold (S/H) drivers within them. This type of TFT-LCD employs a timing controller consisting of shift registers, etc., to control the sampling of video signals, signal line capacitors for holding video signals supplied through signal lines, and pixel capacitors (liquid crystal capacitors plus supplemental capacitors) into which the video signals from the signal line capacitors are written.

FIG. 1 shows a typical TFT-LCD that incorporates S/H drivers. The TFT-LCD 100 has a transmission-type LCD panel 110, a scan driver 120, and a signal driver 130. These components are integrated on an array substrate (not shown).

The display panel 110 has a matrix of signal lines S (representing signal lines S1, S2, and the like that are not shown) and scan lines G (representing scan lines G1, G2, and the like that are not shown). The signal lines S and the scan lines G intersect each other, and at each intersection, there is a TFT 113 serving as a pixel switching element. The TFT 113 has a source electrode connected to the signal line S and a drain electrode connected to a pixel electrode 114. The pixel electrode 114 faces a counter electrode 115 with a liquid crystal layer 116 interposing between them to provide liquid crystal capacitance Clc. The liquid crystal layer 116 is in parallel with a supplemental capacitor 117 that provides supplemental capacitance Cs. The liquid crystal capacitance Clc and supplemental capacitance Cs hold a video signal written through a signal line S for a given period. The counter electrode 115 receives a common potential Vcom from a counter electrode driver (not shown).

The scan driver 120 has shift registers (S/Rs) 121 and scan buffers 122 in pairs. In response to a vertical synchronizing signal IN2 and a vertical clock signal CLK2 from an external driver (not shown), the scan driver 120 successively provides the scan lines G with scan signals.

The signal driver 130 has shift registers (S/Rs) 131, analog switch buffers 132, video buses 133, and analog switches 134. The analog switches 134 are connected to the signal lines S, respectively. In response to a horizontal synchronizing signal IN1 and a horizontal clock signal CLK1 from the external driver, each shift register 131 provides synchronizing signals to control the analog switches 134 through the buffers 132 and analog switch control lines 135. As a result, video signals Video1 to VideoN from the external driver are sampled by the signal lines S at given timing.

In the following explanation, the video buses 133 are classified into as positive and negative video buses P1 to P12 and N1 to N12, and the analog switch control lines 135 are referred to as timing signal lines TS1 to TS4.

A peripheral area or frame area 140 is part of the surface area of the array substrate. The frame area 140 includes the scan driver 120 and signal driver 130 and does not include the display panel 110.

When manufacturing the TFT-LCD 100, the scan driver 120 and signal driver 130 are integrated on an array substrate, which may be an inexpensive glass substrate, through processes similar to those for the display panel 110. Therefore, the TFT-LCD 100 is manufacturable at lower costs than a TFT-LCD that employs a TAB technique to form a signal driver and a scan driver.

The TFT-LCD 100 has the scan driver 120 and signal driver 130 on the same array substrate where the display panel 110 is formed. This arrangement enlarges the frame area 140 compared with the TAB-type TFT-LCD. The present market prefers compact displays with large screens. It is required, therefore, to reduce the frame area 140 by reducing the circuit scale of TFTs that form the drivers in the frame area 140.

The size of an LCD is increasing, and the size of an array substrate is also increasing because each array substrate is required to provide as many panels as possible. A large array substrate involves shrinkage and expansion to increase process variations and deteriorate a positioning accuracy for an exposure unit to 1 $\mu$m or more. It is very difficult, therefore, to further miniaturize the drivers. There is another problem as mentioned below.

FIG. 2 roughly shows the structure of the signal driver 130 of FIG. 1 formed on an array substrate. The scan driver 120 is not directly related to the present invention, and therefore, is omitted. Among the signal lines S, the signal line S1 is provided with an n-channel TFT (hereinafter referred to as "n-TFT") serving as an analog switch SWna, and a p-channel TFT (hereinafter referred to as "p-TFT") serving as an analog switch SWpa. Similarly, the signal line S2 is provided with an n-TFT serving as an analog switch SWnb and a p-TFT serving as an analog switch SWpb. The switches SWna and SWpa form an analog switch pair for the signal line S1, and the switches SWnb and SWpb form an analog switch pair for the signal line S2.

The n-TFT serving as the switch SWna and the p-TFT serving as the switch SWpa are formed side by side in parallel with the signal lines S1, S2, and the like. The drains (D) of these TFTs are connected to wires whose ends are commonly connected to the signal line S1. The source (S) of the n-TFT is connected to wiring that is connected to the video bus P2. The source of the p-TFT is connected to wiring that is connected to the video bus P1. The n- and p-TFTs serving as the switches SWnb and SWpb are similarly connected.

The gate (G) of the n-TFT serving as the switch SWna is connected to the timing signal line TS2, and the gate of the p-TFT serving as the switch SWpa is connected to the timing signal line TS3. The gate of the n-TFT serving as the switch SWnb is connected to the timing signal line TS4, and the gate of the p-TFT serving as the switch SWpb is connected to the timing signal line TS1.

FIGS. 3A and 3B are plan and sectional views showing the n-TFT serving as the switch SWna and the p-TFT serving as the switch SWpa of FIG. 2. FIG. 3A removes the top of the structure of FIG. 3B, i.e., some elements on the counter substrate side, to specifically show contact holes in one manufacturing step. There are a substrate 901, an active layer 911, a gate insulating film 906, an interlayer insulating film 908, a passivation film 910, gate electrodes 907, and source/drain electrodes 909. FIG. 3A shows the contact holes 921 and 922 for the source/drain electrodes 909. The contact holes 921 and 922 are linearly arranged in a gate width direction (a vertical direction in the figure) group by group each composed of four contact holes formed at regular intervals. The contact holes 921 and 922 have square shapes of substantially the same size.

As mentioned above, the LCD having signal and scan drivers integrated on an array substrate is capable of realizing high resolution. Accordingly, studies and developments for high resolution are energetically carried out. For example, 10.4-inch XGA (extended graphics arrays) panels and 8.4-inch SVGA (super video graphics arrays) panels have dot pitches of about 70 $\mu$m. With these dot pitches, analog switch pairs each consisting of an n-TFT and a p-TFT can be formed side by side in parallel with the signal lines S as shown in FIG. 2. On the other hand, 4-inch VGA (video graphics arrays) panels have dot pitches of about 55 $\mu$m, which do not allow the analog switch pairs to be formed side by side in parallel with the signal lines S. In this case, the n-TFTs and p-TFTs of the analog switch pairs must be shifted from each other by a gate width W as shown in FIG. 4. This arrangement must linearly form the drains of the n- and p-TFTs, to enlarge a frame area by at least the gate width W. This may degrade the product value of an LCD.

Shortening the length of each TFT and reducing the size of each contact require additional processes and process modifications, to deteriorate productivity and increase costs.

In this way, the conventional TFT-LCDs incorporating sample-and-hold drivers have the problem that the size of each TFT analog switch limits the resolution of the TFT-LCDs.

SUMMARY OF THE INVENTION

An object of the present invention is to provide an LCD capable of realizing high resolution without deteriorating productivity or increasing costs and the size of a frame area.

In order to accomplish the object, a first aspect of the present invention provides an LCD having a display panel, a signal driver for supplying video signals to signal lines, a scan driver for supplying scan signals to scan lines that intersect the signal lines, and an external driver for driving the signal and scan drivers. The display panel has an array substrate, a counter substrate, and a liquid crystal layer held between the array substrate and the counter substrate. The array substrate has the signal and scan lines, pixel switching elements formed at the intersections of the signal and scan lines, respectively, and pixel electrodes connected to the pixel switching elements, respectively. The counter substrate has counter electrodes that face the pixel electrodes, respectively. The signal driver has positive video buses for transmitting positive video signals, negative video buses for transmitting negative video signals, p-TFT switches each connected to one of the positive video buses through wiring, and n-TFT switches each connected to one of the negative video buses through wiring. Among the p- and n-TFT switches, adjacent p- and n-TFT switches form a pair and are connected to one of the signal lines, and a p-TFT switch connected to a "2N−1"th (N being a natural number) one of the signal lines and a p-TFT switch connected to a "2N"th one of the signal lines have source electrodes connected to a common contact hole that is connected to one of the positive video buses.

The first aspect may connect the source electrode of an n-TFT switch connected to a "2N"th one of the signal lines and the source electrode of an n-TFT switch connected to a "2N+1"th one of the signal lines to a common contact hole that is connected to one of the negative video buses.

A second aspect of the present invention provides an LCD having a display panel, a signal driver for supplying video signals to signal lines, a scan driver for supplying scan signals to scan lines that intersect the signal lines, and an external driver for driving the signal and scan drivers. The display panel has an array substrate, a counter substrate, and a liquid crystal layer held between the array substrate and the counter substrate. The array substrate has the signal and scan lines, pixel switching elements formed at the intersections of the signal and scan lines, respectively, and pixel electrodes connected to the pixel switching elements, respectively. The counter substrate has counter electrodes that face the pixel electrodes, respectively. The signal driver has positive video buses for transmitting positive video signals, negative video buses for transmitting negative video signals, p-TFT switches each connected to one of the positive video buses through wiring, and n-TFT switches each connected to one of the negative video buses through wiring. Among the p- and n-TFT switches, adjacent p- and n-TFT switches form a switch pair and are connected to one of the signal lines, and an n-TFT switch connected to a "2N−1"th (N being a natural number) one of the signal lines and an n-TFT switch connected to a "2N"th one of the signal lines have source electrodes connected to a common contact hole that is connected to one of the negative video buses.

The second aspect may connect the source electrode of a p-TFT switch connected to a "2N"th one of the signal lines and the source electrode of a p-TFT switch connected to a "2N+1"th one of the signal lines to a common contact hole that is connected to one of the positive video buses.

The first and second aspects share contact holes among the n- and p-TFT switches, to shorten the width of each switch pair. Compared with the prior art that separately forms source contact holes for n- and p-TFT switches, the first and second aspects can juxtapose the switch pairs to realize finer pixel pitches. Even at fine pixel pitches that the prior art must alternate p- and n-TFT switches, the present invention can form p- and n-TFT switches in parallel, to reduce circuit size. When applied to an LCD incorporating sample-and-hold drivers, the present invention realizes a simple structure to minimize a frame area of the LCD. Namely, the present invention provides a high-resolution LCD without enlarging a frame area where a signal driver is formed. The present invention forms pairs of p- and n-TFT switches on an array substrate through conventional manufacturing processes. Namely, the present invention needs no additional processes or process modifications for reducing TFT length and contact size, and therefore, involves no productivity loss or cost increase.

A third aspect of the present invention provides an LCD having a display panel, a signal driver for supplying video signals to signal lines, a scan driver for supplying scan signals to scan lines that intersect the signal lines, and an external driver for driving the signal and scan drivers. The display panel has an array substrate, a counter substrate, and a liquid crystal layer held between the array substrate and the counter substrate. The array substrate has the signal and scan lines, pixel switching elements formed at the intersections of the signal and scan lines, respectively, and pixel electrodes connected to the pixel switching elements, respectively. The counter substrate has counter electrodes that face the pixel electrodes, respectively. The signal driver has positive video buses for transmitting positive video signals, negative video buses for transmitting negative video signals, p-TFT switches each connected to one of the positive video buses through wiring, and n-TFT switches each connected to one of the negative video buses through wiring. Adjacent p- and n-TFT switches among the p- and n-TFT switches form a switch pair and have drain electrodes that are adjacent to each other and are connected to one of the signal lines through a common contact hole extending over the drain electrodes.

The third aspect shares contact holes among the p- and n-TFT switches, to shorten the width of each switch pair. As a result, the third aspect can form the switch pairs side by side to realize fine pixel pitches and high resolution without enlarging a frame area of the LCD.

The third aspect may enlarge the common contact hole for the drain electrodes of each switch pair at least twice as large as each of contact holes for connecting the source electrodes of the switch pair to the video buses.

This realizes high resolution without enlarging an LCD frame area and secures electron mobility.

A fourth aspect of the present invention provides an LCD having a display panel, a signal driver for supplying video signals to signal lines, a scan driver for supplying scan signals to scan lines that intersect the signal lines, and an external driver for driving the signal and scan drivers. The display panel has an array substrate, a counter substrate, and a liquid crystal layer held between the array substrate and the counter substrate. The array substrate has the signal and scan lines, pixel switching elements formed at the intersections of the signal and scan lines, respectively, and pixel electrodes connected to the pixel switching elements, respectively. The counter substrate has counter electrodes that face the pixel electrodes, respectively. The signal driver has positive video buses for transmitting positive video signals, negative video buses for transmitting negative video signals, p-TFT switches each connected to one of the positive video buses through wiring, and n-TFT switches each connected to one of the negative video buses through wiring. Adjacent p- and n-TFT switches among the p- and n-TFT switches form a switch pair, the drain electrodes of each switch pair have toothed areas, respectively, and the toothed areas of each switch pair mesh with each other and are connected to one of the signal lines through contact holes each formed on a protruding tooth of the meshing toothed areas.

The fourth aspect forms a plurality of contact holes on each source/drain electrode of each TFT switch substantially along a straight line, to reduce the width of each switch pair. As a result, the fourth aspect can juxtapose switch pairs to narrow pixel pitches and realize high resolution without enlarging an LCD frame area. The fourth aspect provides the drain electrodes of adjacent TFT switches with toothed areas meshing with each other, to make a total drain width narrower than that of the third aspect, thereby further reducing dot pitches.

The fourth aspect may shape the contact holes on the meshing toothed areas of each switch pair into a single groove.

This secures electron mobility and simplifies device patterns to manufacture the LCD.

DESCRIPTION OF THE PREFERRED EMBODIMENTS

Various embodiments of the present invention will be described with reference to the accompanying drawings.

[Embodiment 1]

Figure 1:
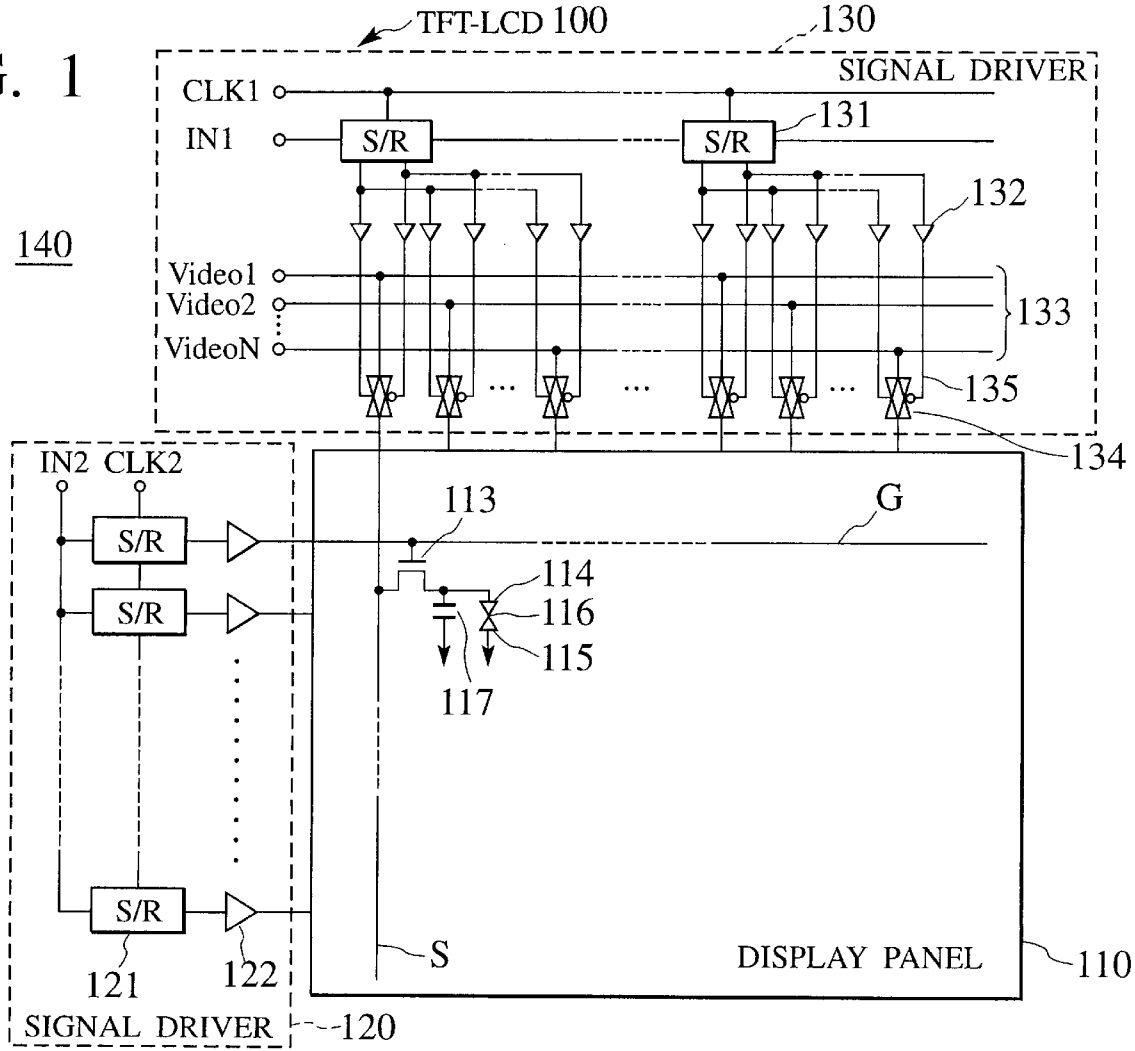
FIG. 1 is a circuit diagram showing a TFT-LCD incorporating standard sample-and-hold drivers according to a prior art.
Figure 5:
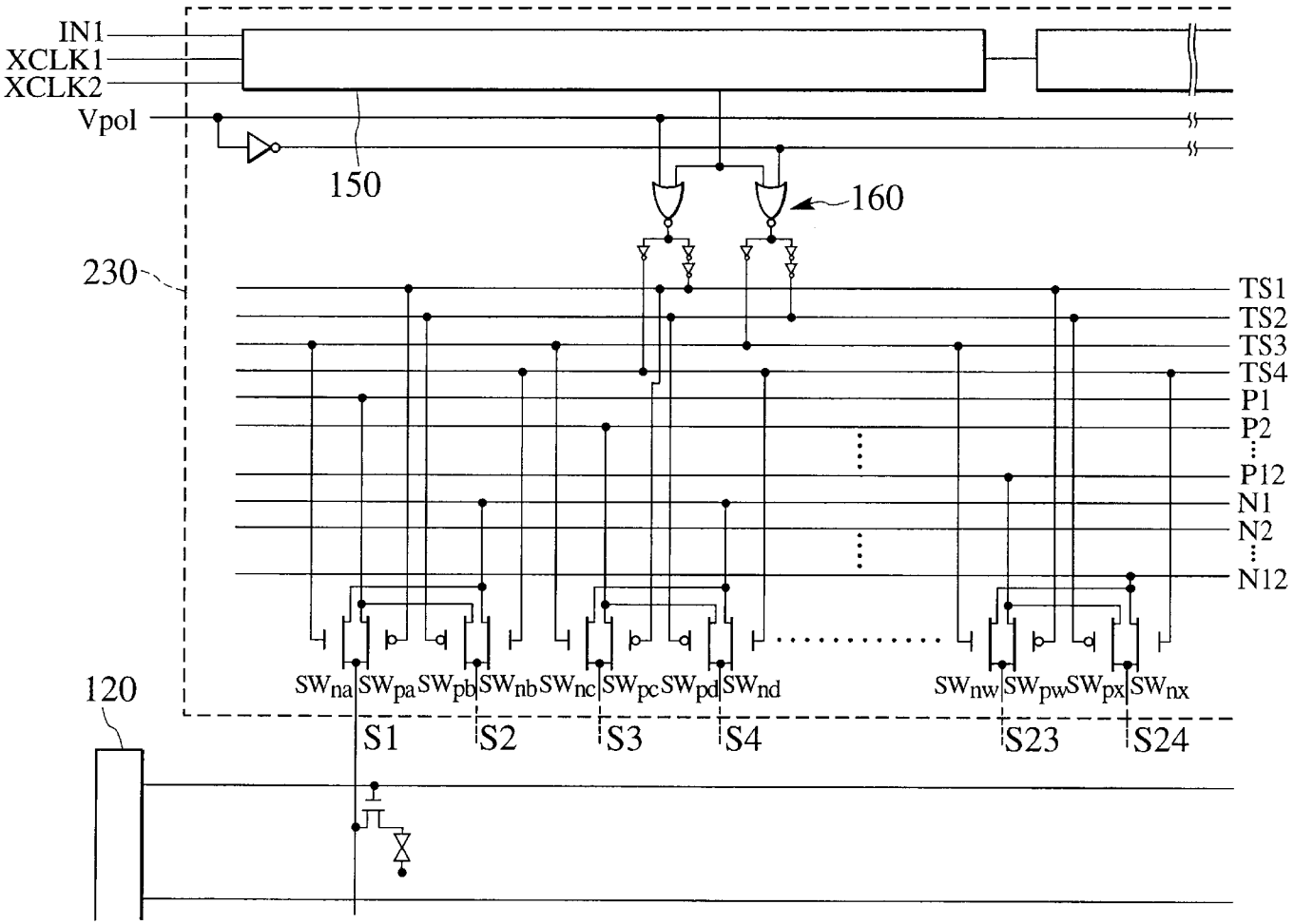
FIG. 5 is a circuit diagram showing a TFT-LCD according to embodiment 1 of the present invention.

FIG. 5 is a circuit diagram showing a TFT-LCD according to the embodiment 1 of the present invention. FIG. 5 specifically shows a signal driver of the TFT-LCD and the periphery thereof. The TFT-LCD of the embodiment 1 drives a display panel in quartered areas and eight phases, and therefore, the signal driver thereof is different from the signal driver 130 of FIG. 1. The other parts of the embodiment 1 are basically the same as those of FIG. 1, and therefore, are represented with like reference marks. Some parts of FIGS. 1 to 4, however, have different marks and names from those of FIG. 1 even if they are substantially equal to each other.

In FIG. 5, an array substrate (not shown) has 32 blocks of signal lines with each block consisting of 24 signal lines S1 to S24 running in parallel with one another. FIG. 5 shows only one of the 32 blocks. The signal lines are driven by a signal driver 230 that is integrated on the array substrate.

The signal driver 230 has 32 shift registers 150 of clocked-inverter type. FIG. 5 shows only part of the 32 shift registers 150. The shift register 150 is driven in response to a horizontal synchronizing signal IN1 and horizontal clock signals XCLK1 and XCLK2. The signals IN1, XCLK1, and XCLK2 are supplied from an external driver (not shown). The signal driver 230 also has video buses P1 to P12 for transmitting positive video signals, video buses N1 to N12 for transmitting negative video signals, p-channel analog switches SWpa to SWpx, and n-channel analog switches SWna to SWnx. These analog switches are controlled by the output of the shift register 150, to transfer video signals from the video buses P1 to P12 and N1 to N12 to the signal lines S1 to S24.

The embodiment 1 vertically divides the display panel into four areas and provides each of the four areas with 32 blocks of signal lines with each block consisting of 24 signal lines S1 to S24 running in parallel with one another.

The output of the shift register 150 is passed through a signal switching circuit 160 to timing signal lines TS1 to TS4. The timing signal lines TS1 to TS4 correspond to the signal lines S1 to S24 and are connected to the gate electrodes of MOS transistors that serve as the analog switches SWna to SWnx and SWpa to SWpx.

The signal switching circuit 160 receives a polarity inverting signal Vpol from the external driver (not shown) and inverts the polarity of a video signal supplied to a signal line frame by frame. Namely, adjacent signal lines alternately receive positive and negative video signals frame by frame.

Figure 6:
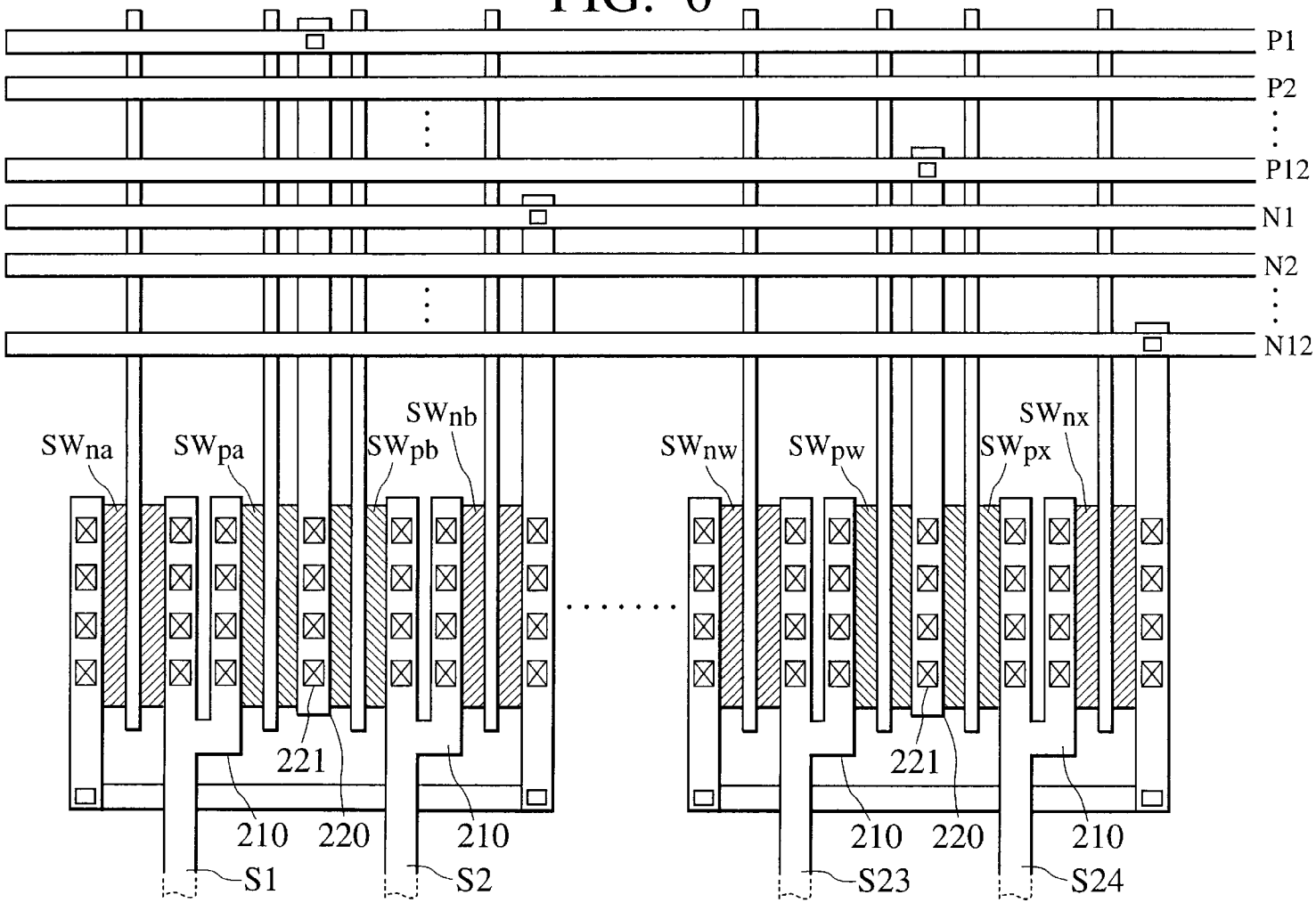
FIG. 6 is an enlarged view showing analog switches of the embodiment 1.

FIG. 6 is an enlarged view showing the analog switches connected to the signal lines S1, S2, S23, and S24 of FIG. 5.

The analog switches SWpa and SWpb are connected to the positive video bus P1, and the analog switches SWpw and SWpx are connected to the positive video bus P12. These analog switches are p-TFTs, respectively. The analog switches SWna and SWnb are connected to the negative video bus N1, and the analog switches SWnw and SWnx are connected to the negative video bus N12. These analog switches are n-TFTs, respectively.

Each of the signal lines S1 to S24 is connected to the drain electrodes 210 of a pair of p- and n-channel analog switches, these drain electrodes 210 being connected to each other to invert the polarity of the signal line. The analog switches are arranged in parallel with one another.

When the embodiment 1 carries out vertical line inversion, the "2N−1"th (N being natural numbers) signal lines S1, S3, . . . , and S23 are positively driven when the "2N"th signal lines S2, S4, . . . , and S24 are negatively driven. When the signal lines S1, S3, . . . , and S23 are negatively driven, the signal lines S2, S4, . . . , and S24 are positively driven. The polarity of each signal line is inverted frame by frame, to display flicker-free images.

Each analog switch pair must be formed within a dot pitch width. A drain electrode 210 of the p-TFT serving as the analog switch SWpa is connected to the signal line S1, and a drain electrode 210 of the p-TFT serving as the analog switch SWpb is connected to the signal line S2. Source electrodes 220 of the analog switches SWpa and SWpb have common contact holes 221 and are commonly connected to the positive video bus P1.

This arrangement is capable of reducing the width of each analog switch pair. For example, the analog switches can be arranged at dot pitches of about 55 $\mu$m without enlarging a frame area where the signal driver 230 is formed.

Figure 7:
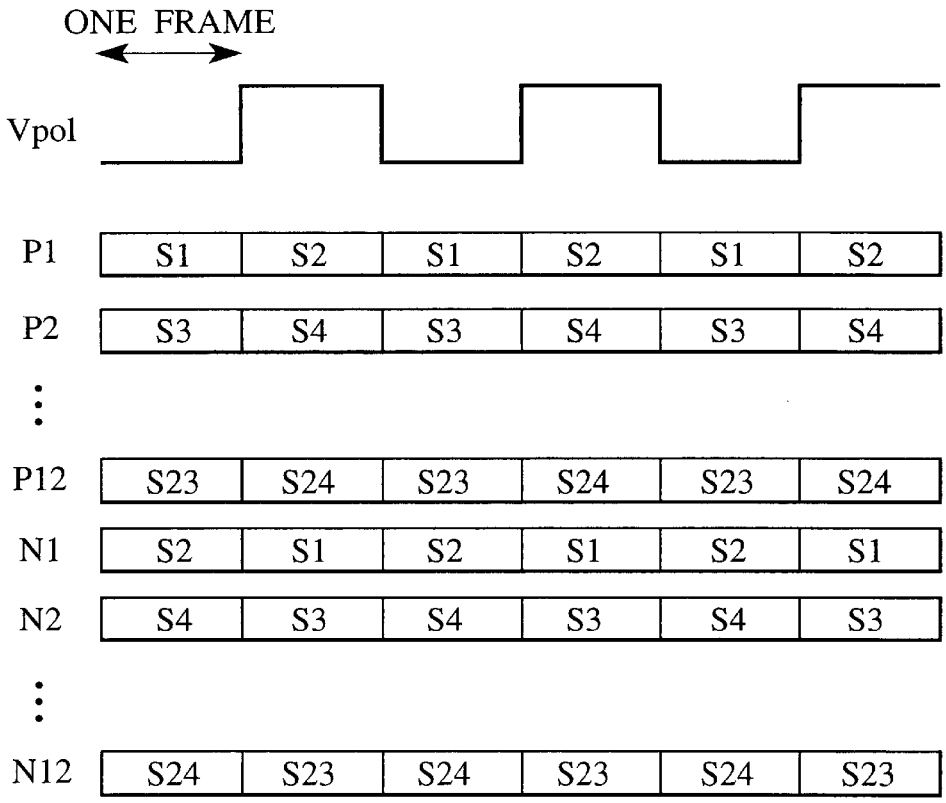
FIG. 7 shows sequences of video signals supplied to video buses of FIG. 6.

FIG. 7 shows sequences of video signals supplied to the video buses. The polarities of video signals supplied to the video buses P1 to P12 and N1 to N12 are inverted frame by frame in response to the polarity inverting signal Vpol. In the vertical line inversion, the positive video bus P1 supplies a video signal to the signal line S1 in each odd frame, and in each even frame, to the signal line S2. The negative video bus N1 supplies a video signal to the signal line S2 in each odd frame, and in each even frame, to the signal line S1. The polarities of video signals in the odd and even frames may be opposite to those mentioned above in carrying out the vertical line inversion.

[Embodiment 2]

A TFT-LCD according to the embodiment 2 of the present invention will be explained. The embodiment 2 replaces the p- and n-channel analog switches of the embodiment 1 (FIG. 5) with each other. Namely, the embodiment 2 arranges analog switches side by side and provides the source electrodes of adjacent n-TFTs with common contact holes. The general structure of the TFT-LCD of the embodiment 2 is the same as that of the embodiment 1, and therefore, will not be explained again.

Figure 8:
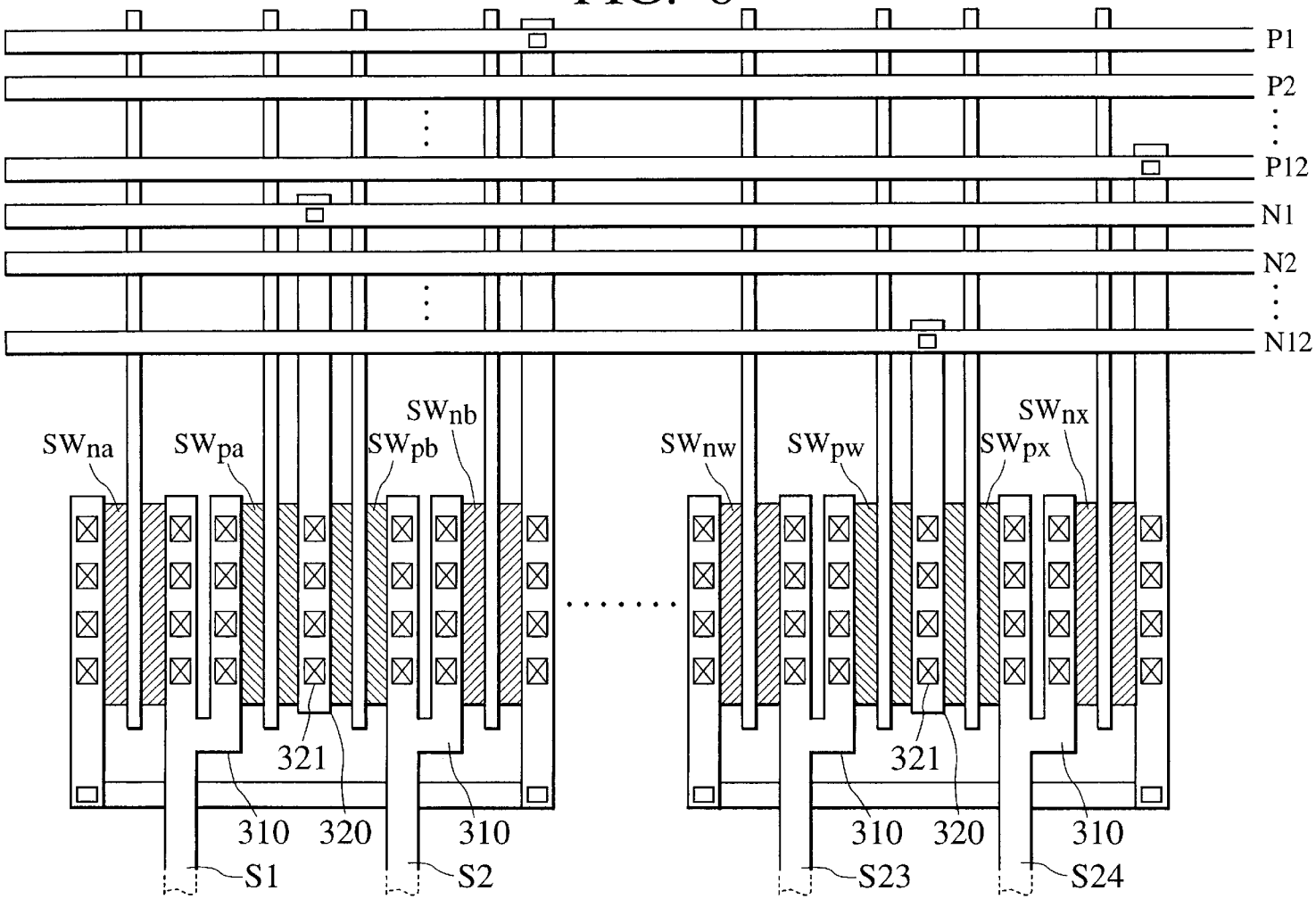
FIG. 8 is an enlarged view showing analog switches of a TFT-LCD according to embodiment 2 of the present invention.

FIG. 8 is an enlarged view showing analog switches connected to signal lines S1, S2, S23, and S24 of the embodiment 2. In FIG. 8, the same parts as those of FIG. 6 are represented with like reference marks.

The analog switches SWpa and SWpb are connected to a positive video bus P1, and the analog switches SWpw and SWpx are connected to a positive video bus P12. These analog switches are p-TFTs. The analog switches SWna and SWnb are connected to a negative video bus N1, and the analog switches SWnw and SWnx are connected to a negative video bus N12. These analog switches are n-TFTs.

Each of the signal lines S1 to S24 is connected to a pair of p- and n-TFTs serving as adjacent analog switches. The drain electrodes 310 of the pair are commonly connected to a corresponding signal line, to carry out polarity inversion.

When the embodiment 2 carries out vertical line inversion, the "2N−1"th signal lines S1, S3, . . . , and S23 are positively driven when the "2N"th signal lines S2, S4, . . . , S24 are negatively driven. When the signal lines S1, S3, . . . , and S23 are negatively driven, the signal lines S2, S4, . . . , and S24 are positively driven. The polarity of each signal line is inverted frame by frame, to display flicker-free images.

Each analog switch pair must be formed within a dot pitch width. A drain electrode 310 of the n-TFT serving as the analog switch SWna is connected to the signal line S1, and a drain electrode 310 of the n-TFT serving as the analog switch SWnb is connected to the signal line S2. Source electrodes 320 of the analog switches SWna and SWnb are commonly connected to the negative video bus N1 through common contact holes 321.

This arrangement is capable of reducing the width of each analog switch pair. For example, the analog switches can be arranged at dot pitches of about 55 $\mu$m without enlarging a frame area where the signal driver is formed.

Video signals supplied to the video buses P1 to P12 and N1 to N12 are the same as those of the embodiment 1 of FIG. 7.

[Embodiment 3]

A TFT-LCD according to the embodiment 3 of the present invention will be explained. The embodiment 3 juxtaposes analog switches having the structure of the embodiment 1 and shares contact holes between the source electrodes of adjacent p- and n-TFTs.

Figure 9:
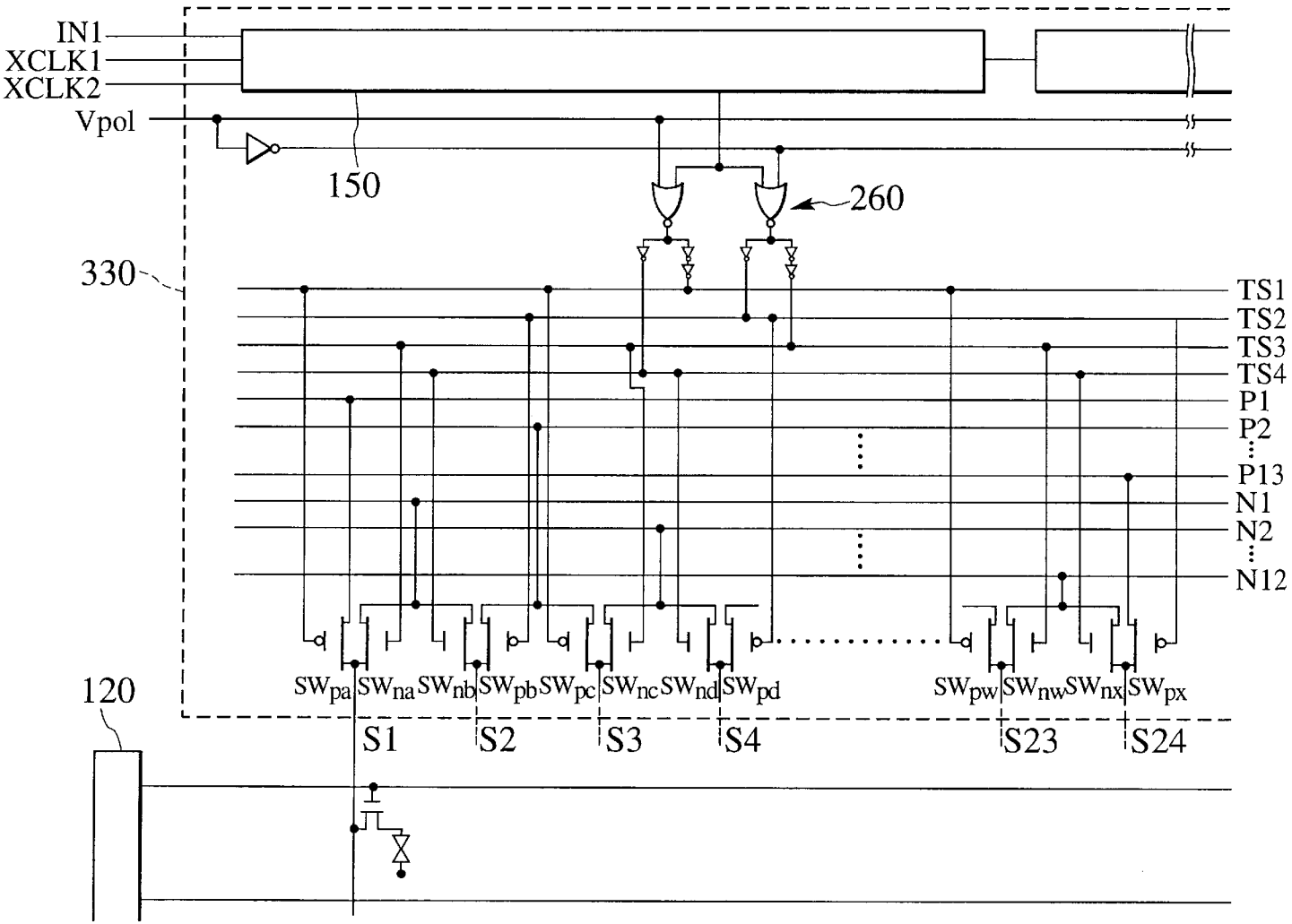
FIG. 9 is a circuit diagram showing a TFT-LCD according to embodiment 3 of the present invention.

FIG. 9 is a circuit diagram showing the TFT-LCD of the embodiment 3. This figure specifically shows a signal driver 330 of the TFT-LCD and the periphery thereof. The TFT-LCD of the embodiment 3 drives a display panel in quartered areas and eight phases. The signal driver 330 differs from the signal driver 230 of FIG. 5 in the arrangement of analog switches and in the connections of timing signal lines and video buses. The other parts of FIG. 9 are the same as those of FIG. 5, and therefore, the same parts are represented with like reference marks.

In FIG. 9, an array substrate (not shown) has 32 blocks of signal lines with each block consisting of 24 signal lines S1 to S24 running in parallel with one another. FIG. 9 shows only one of the 32 blocks. The signal lines are driven by the signal driver 330 that is integrated on the array substrate.

The signal driver 330 has 32 shift registers 150 of clocked-inverter type. FIG. 9 shows only part of the 32 shift registers 150. The shift register 150 is driven in response to a horizontal synchronizing signal IN1 and horizontal clock signals XCLK1 and XCLK2. The signals IN1, XCLK1, and XCLK2 are supplied from an external driver (not shown). The signal driver 330 also has video buses P1 to P13 for transmitting positive video signals, video buses N1 to N12 for transmitting negative video signals, p-channel analog switches SWpa to SWpx, and n-channel analog switches SWna to SWnx. The analog switches SWpa to SWpx and SWna to SWnx are controlled by the output of the shift register 150, to transfer video signals from the video buses P1 to P13 and N1 to N12 to the signal lines S1 to S24.

The source electrode of the analog switch SWpa is solely connected to the positive video bus P1, and therefore, the number of positive video buses is greater than that of the negative video buses by one.

The embodiment 3 vertically divides the display panel into four areas and provides each of the four areas with 32 blocks of signal lines with each block consisting of 24 signal lines S1 to S24 formed in parallel with one another.

The output of the shift register 150 is passed through a signal switching circuit 260 to timing signal lines TS1 to TS4. The timing signal lines TS1 to TS4 correspond to the signal lines S1 to S24 and are connected to the gate electrodes of MOS transistors that serve as the analog switches SWna to SWnx and SWpa to SWpx.

The signal switching circuit 260 receives a polarity inverting signal Vpol from the external driver (not shown) and inverts the polarity of a video signal supplied to a signal line frame by frame. Namely, adjacent signal lines alternately receive positive and negative video signals frame by frame.

Figure 10:
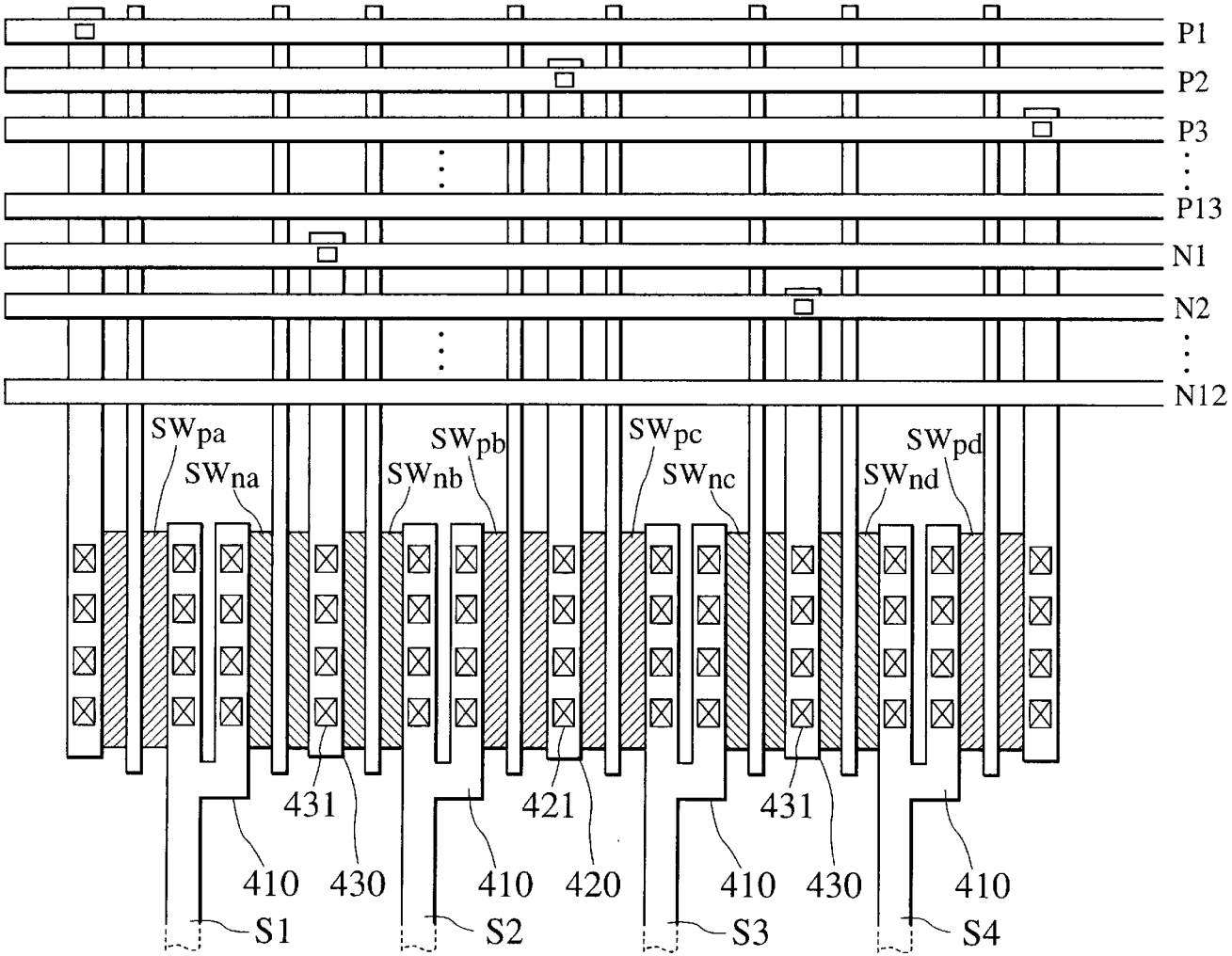
FIG. 10 is an enlarged view showing analog switches of the embodiment 3.

FIG. 10 is an enlarged view showing the analog switches connected to the signal lines S1, S2, S3, and S4 of FIG. 9.

The analog switch SWpa is connected to the positive video bus P1, and the analog switches SWpb and SWpc are connected to the positive video bus P2. These analog switches are p-TFTs, respectively. The analog switches SWna and SWnb are connected to the negative video bus N1, and the analog switches SWnc and SWnd are connected to the negative video bus N2. These analog switches are n-TFTs, respectively.

Each of the signal lines S1 to S4 is connected to a pair of p- and n-channel analog switches whose drain electrodes 410 are connected to each other to invert the polarity of the signal line. The analog switches are arranged in parallel with one another.

When the embodiment 3 carries out vertical line inversion, the "2N−1"th signal lines S1, S3, . . . , and S23 are positively driven when the "2N"th signal lines S2, S4, . . . , S24 are negatively driven. When the signal lines S1, S3, . . . , and S23 are negatively driven, the signal lines S2, S4, . . . , and S24 are positively driven. The polarity of each signal line is inverted frame by frame, to display flicker-free images.

Each analog switch pair must be formed within a dot pitch width. A drain electrode 410 of the p-TFT serving as the analog switch SWpa is connected to the signal line S1, and a drain electrode 410 of the p-TFT serving as the analog switch SWpb is connected to the signal line S2. A drain electrode 410 of the p-TFT serving as the analog switch SWpc is connected to the signal line S3. Source electrodes 420 of the analog switches SWpb and SWpc are commonly connected to the positive video bus P2 through common contact holes 421.

A drain electrode 410 of the n-TFT serving as the analog switch SWna is connected to the signal line S1, and a drain electrode 410 of the n-TFT serving as the analog switch SWnb is connected to the signal line S2. Source electrodes 430 of the analog switches SWna and SWnb are commonly connected to the negative video bus N1 through common contact holes 431. The source electrodes 420 of the analog switches SWpb and SWpc have the common contact holes 421, the source electrodes 430 of the analog switches SWna and SWnb have the common contact holes 431, and source electrodes 430 of the analog switches SWnc and SWnd have common contact holes 431.

This arrangement is capable of reducing the width of each analog switch pair. For example, the analog switches can be arranged at dot pitches of about 50 $\mu$m without enlarging a frame area where the signal driver is formed.

Figure 11:
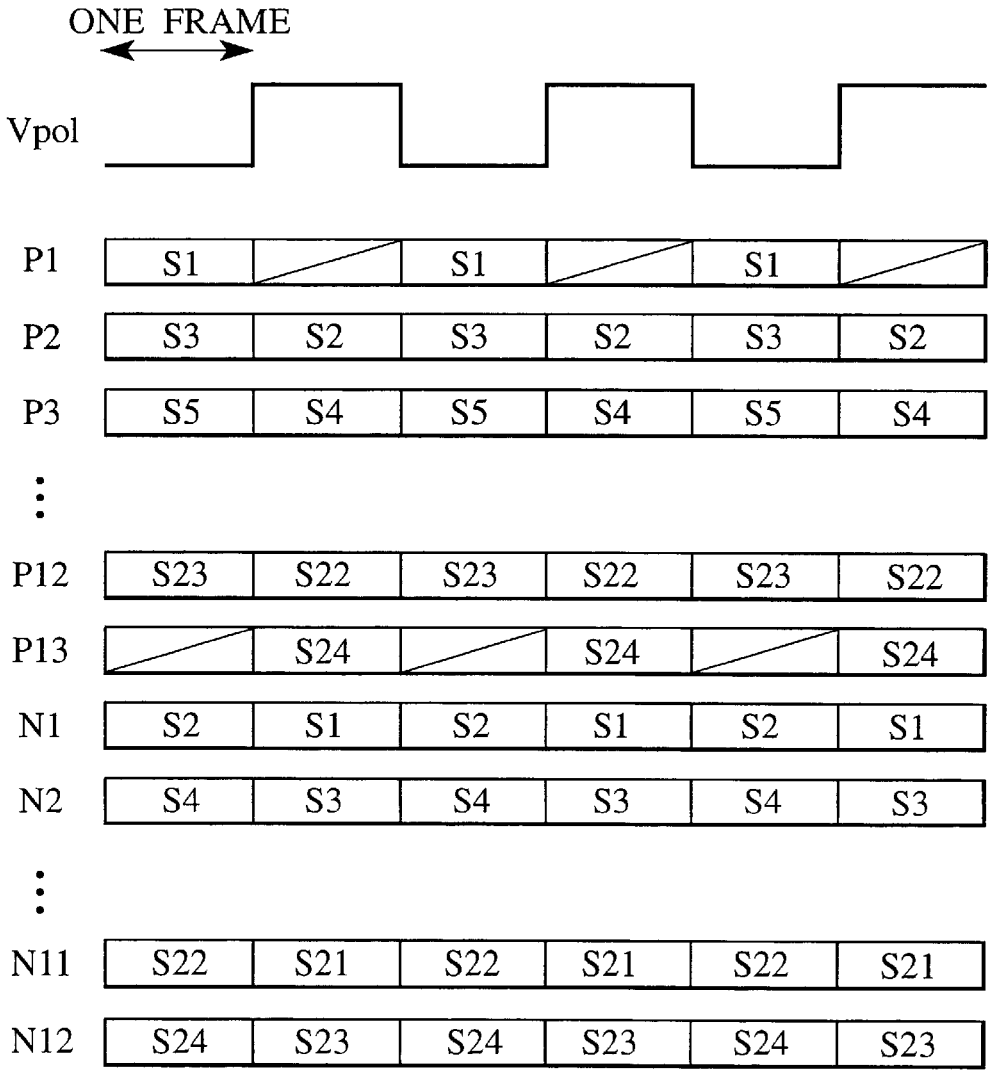
FIG. 11 shows sequences of video signals supplied to video buses of FIG. 10.

FIG. 11 shows sequences of video signals supplied to the video buses. The polarities of video signals supplied to the video buses P1 to P13 and N1 to N12 are inverted frame by frame in response to the polarity inverting signal Vpol. In the vertical line inversion, the positive video bus P2 supplies a video signal to the signal line S3 in each odd frame, and in each even frame, to the signal line S2. The positive video bus P1 supplies a video signal to the signal line S1 only in each odd frame, and the positive video bus P13 supplies a video signal to the signal line S24 only in each even frame. The negative video bus N1 supplies a video signal to the signal line S2 in each odd frame, and in each even frame, to the signal line S1. The polarities of video signals in odd and even frames may be opposite to those mentioned above, to carry out the vertical line inversion.

[Embodiment 4]

A TFT-LCD according to the embodiment 4 of the present invention will be explained. The embodiment 4 replaces the p- and n-channel analog switches of the embodiment 3 (FIG. 9) with each other.

Figure 12:
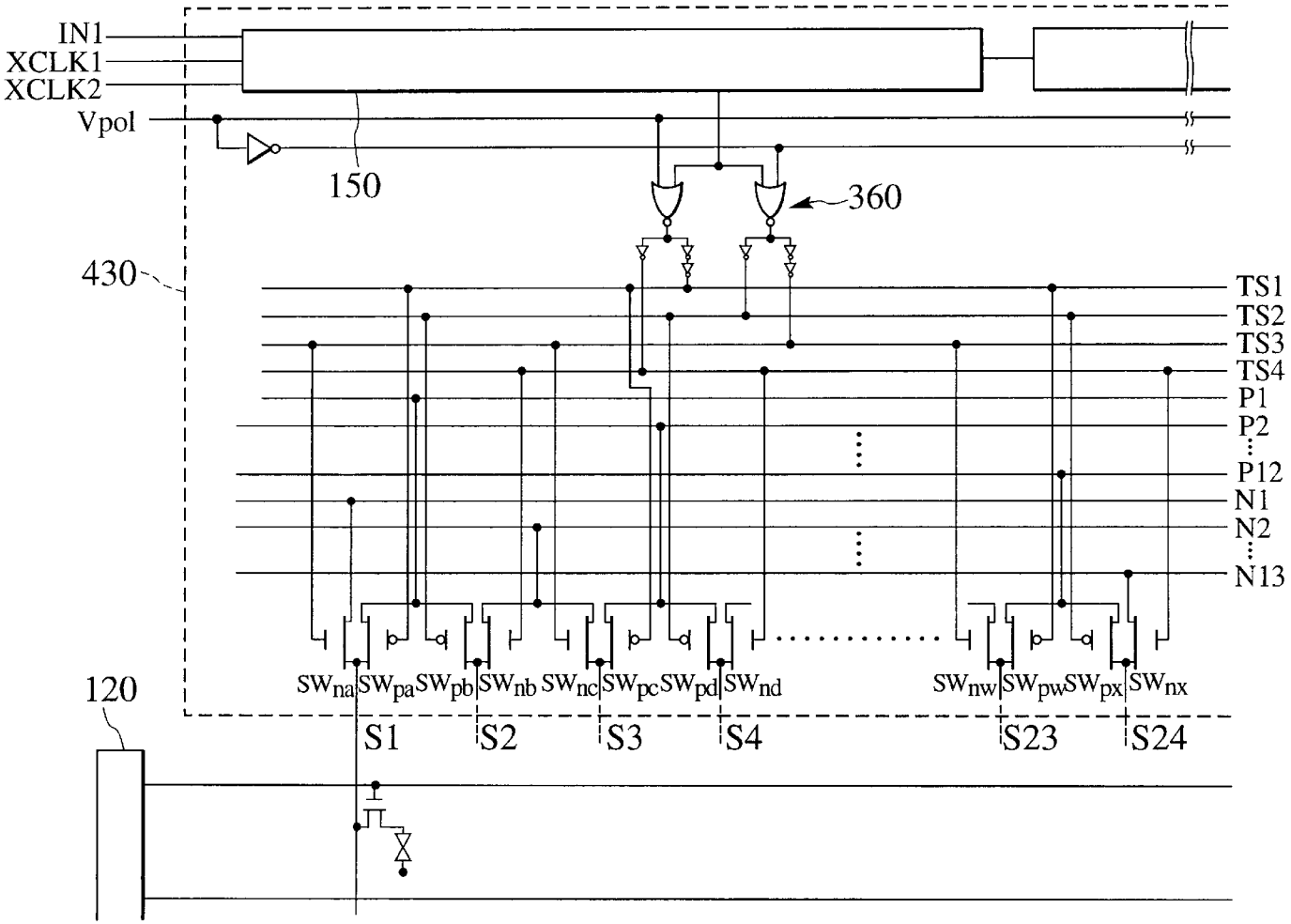
FIG. 12 is a circuit diagram showing a TFT-LCD according to embodiment 4 of the present invention.

FIG. 12 is a circuit diagram showing the TFT-LCD of the embodiment 4. This figure specifically shows a signal driver 430 of the TFT-LCD and the periphery thereof. The TFT-LCD of the embodiment 4 drives a display panel in quartered areas and eight phases. The signal driver 430 differs from the signal driver 330 of FIG. 9 in the arrangement of analog switches and in the connections of timing signal lines and video buses. The other parts of FIG. 12 are the same as those of FIG. 9, and therefore, the same parts are represented with like reference marks.

In FIG. 12, an array substrate (not shown) has 32 blocks of signal lines with each block consisting of 24 signal lines S1 to S24 running in parallel with one another. FIG. 12 shows only one of the 32 blocks. The signal lines are driven by the signal driver 430 that is integrated on the array substrate.

The signal driver 430 has 32 shift registers 150 of clocked-inverter type. FIG. 12 shows only part of the 32 shift registers 150. The shift register 150 is driven in response to a horizontal synchronizing signal IN1 and horizontal clock signals XCLK1 and XCLK2. The signals IN1, XCLK1, and XCLK2 are supplied from an external driver (not shown). The signal driver 430 also has video buses P1 to P12 for transmitting positive video signals, video buses N1 to N13 for transmitting negative video signals, p-channel analog switches SWpa to SWpx, and n-channel analog switches SWna to SWnx. The analog switches SWpa to SWpx and SWna to SWnx are controlled by the output of the shift register 150, to transfer video signals from the video buses P1 to P12 and N1 to N13 to the signal lines S1 to S24.

The source electrode of the analog switch SWnx is solely connected to the negative video bus N13, and therefore, the number of negative video buses is greater than that of the positive video buses by one.

The embodiment 4 vertically divides the display panel into four areas and provides each of the four areas with 32 blocks of signal lines with each block consisting of 24 signal lines S1 to S24 formed in parallel with one another.

The output of the shift register 150 is passed through a signal switching circuit 360 to timing signal lines TS1 to TS4. The timing signal lines TS1 to TS4 correspond to the signal lines S1 to S24 and are connected to the gate electrodes of MOS transistors that serve as the analog switches SWna to SWnx and SWpa to SWpx.

The signal switching circuit 360 receives a polarity inverting signal Vpol from the external driver (not shown) and inverts the polarity of a video signal supplied to a signal line frame by frame. Namely, adjacent signal lines alternately receive positive and negative video signals frame by frame.

Figure 13:
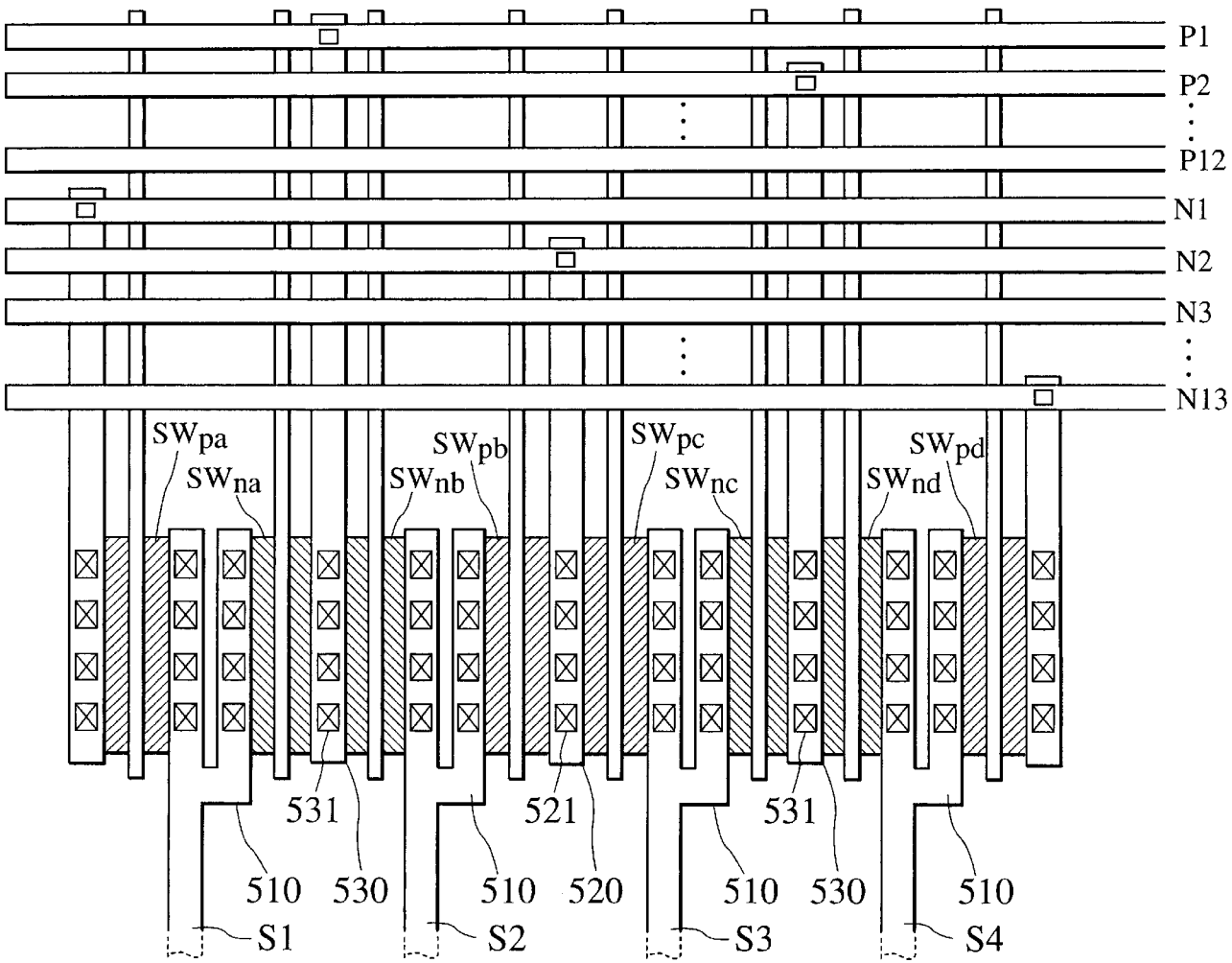
FIG. 13 is an enlarged view showing analog switches of the embodiment 4.

FIG. 13 is an enlarged view showing the analog switches connected to the signal lines S1, S2, S3, and S4 of FIG. 12.

The analog switch SWna is connected to the negative video bus N1, and the analog switches SWnb and SWnc are connected to the negative video bus N2. These analog switches are n-TFTs, respectively. The analog switches SWpa and SWpb are connected to the positive video bus P1, and the analog switches SWpc and SWpd are connected to the positive video bus P2. These analog switches are p-TFTs, respectively.

Each of the signal lines S1 to S4 is connected to a pair of p- and n-channel analog switches whose drain electrodes 510 are connected to each other to invert the polarity of the signal line. The analog switches are arranged in parallel with one another.

When the embodiment 4 carries out vertical line inversion, the "2N−1"th signal lines S1, S3, . . . , and S23 are positively driven when the "2N"th signal lines S2, S4, . . . , S24 are negatively driven. When the signal lines S1, S3, . . . , and S23 are negatively driven, the signal lines S2, S4 . . . , and S24 are positively driven. The polarity of each signal line is inverted frame by frame, to display flicker-free images.

Each analog switch pair must be formed within a dot pitch width. A drain electrode 510 of the n-TFT serving as the analog switch SWna is connected to the signal line S1, and a drain electrode 510 of the n-TFT serving as the analog switch SWnb is connected to the signal line S2. A drain electrode 510 of the n-TFT serving as the analog switch SWnc is connected to the signal line S3. Source electrodes 520 of the analog switches SWnb and SWnc are commonly connected to the negative video bus N2 through common contact holes 521.

A drain electrode 510 of the p-TFT serving as the analog switch SWpa is connected to the signal line S1, and a drain electrode 510 of the p-TFT serving as the analog switch SWpb is connected to the signal line S2. Source electrodes 530 of the analog switches SWpa and SWpb are commonly connected to the positive video bus P1 through common contact holes 531. The source electrodes 520 of the analog switches SWnb and SWnc have the common contact holes 521. The source electrodes 530 of the analog switches SWpa and SWpb have common contact holes 531. The source electrodes 530 of the analog switches SWpc and SWpd have common contact holes 531.

This arrangement is capable of reducing the width of each analog switch pair. For example, the analog switches can be arranged at dot pitches of about 50 $\mu$m without enlarging a frame area where the signal driver is formed.

Figure 14:
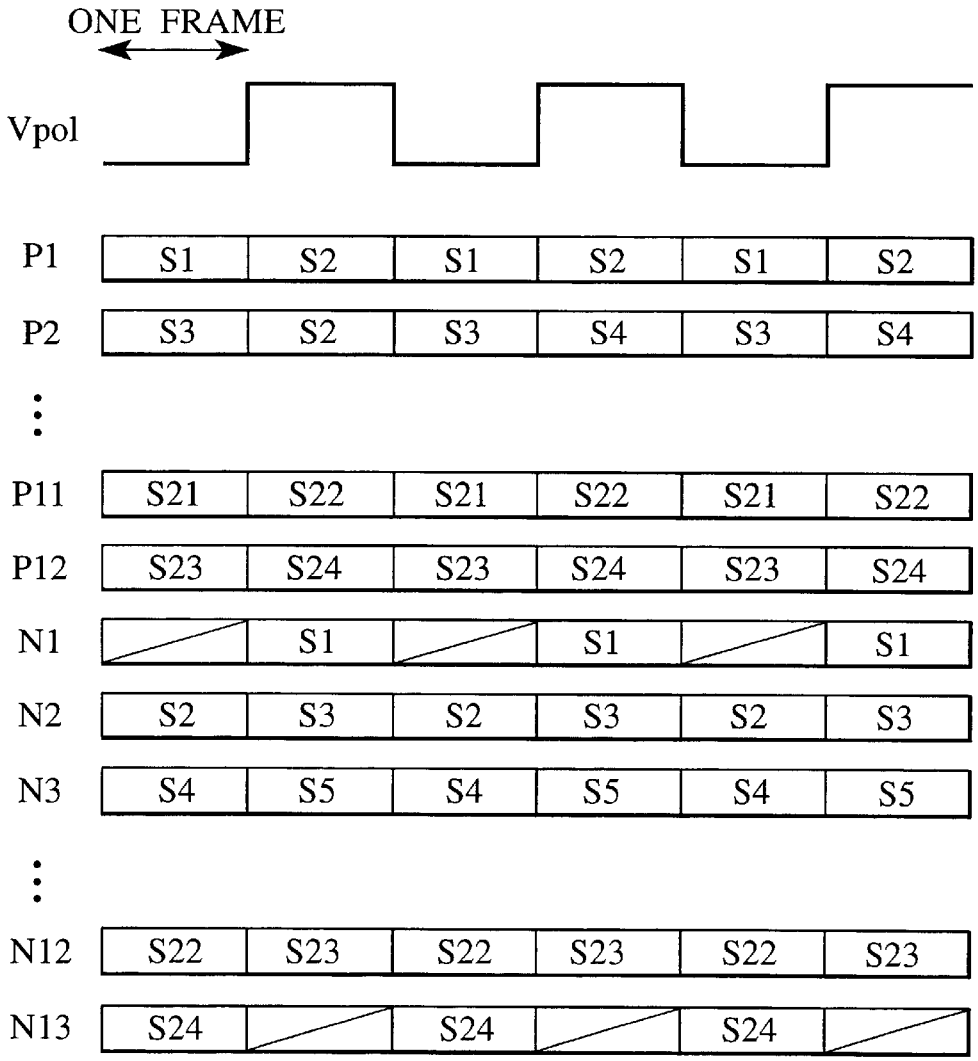
FIG. 14 shows sequences of video signals supplied to video buses of FIG. 13.

FIG. 14 shows sequences of video signals supplied to the video buses. The polarities of video signals supplied to the video buses P1 to P12 and N1 to N13 are inverted frame by frame in response to the polarity inverting signal Vpol. In the vertical line inversion, the positive video bus P1 supplies a video signal to the signal line S1 in each odd frame, and in each even frame, to the signal line S2. The negative video bus N2 supplies a video signal to the signal line S2 in each odd frame, and in each even frame, to the signal line S3. The negative video bus N1 supplies a video signal to the signal line S1 only in each even frame, and the negative video bus N13 supplies a video signal to the signal line S24 only in each odd frame. The polarities of video signals in odd and even frames may be opposite to those mentioned above, to carry out the vertical line inversion.

Figure 15:
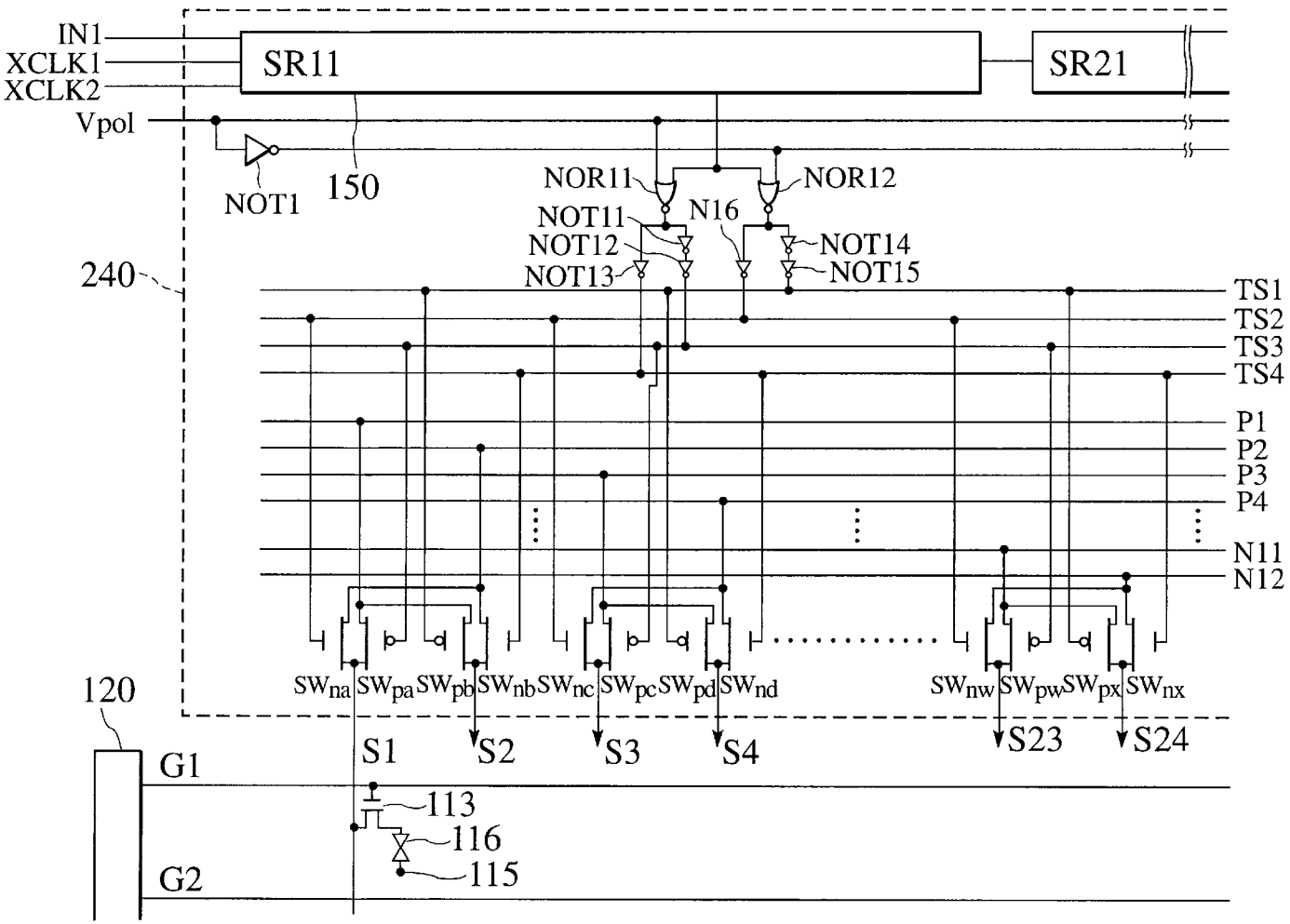
FIG. 15 is a circuit diagram showing a TFT-LCD according to embodiment 5 of the present invention.

Each of the embodiments 1 to 4 employs a pair of p- and n-TFTs to form an analog switch pair and connects the source electrodes of the pair TFTs to common contact holes. Embodiments that employ an analog switch pair whose drain electrodes are connected to common contact holes will be explained. In FIG. 15 and in other figures that follow, some parts that are identical to those of FIGS. 5 to 14 have different names and reference marks.

[Embodiment 5]

FIG. 15 shows a TFT-LCD according to the embodiment 5 of the present invention. This figure specifically shows a signal driver of the TFT-LCD and the periphery thereof. The TFT-LCD of the embodiment 5 drives a display panel in quartered areas and eight phases.

In FIG. 15, the signal driver 240 is formed in an upper end area of an array substrate (not shown). A scan driver 120 is formed in a left end area of the array substrate. The array substrate also has signal lines S1 to S24, scan lines G1, G2, and the like, and TFTs 113. The TFTs 113 serve as pixel switching elements and are formed at the intersections of the signal and scan lines. The signal lines, scan lines, and TFTs are integrated on the array substrate. The array substrate faces a counter substrate (not shown) with a predetermined gap between them. The counter substrate has counter electrodes 115. Between the array substrate and the counter substrate, a liquid crystal layer 116 is held, to form a liquid crystal display panel serving as a main part of the TFT-LCD. FIG. 15 mainly shows the signal driver 240 because it directly relates to the present invention. The scan driver 120 is depicted as a simple block because it does not directly relate to the present invention.

The signal driver 240 has shift registers SR11, SR21, and the like, a polarity inverting circuit having an inverter NOT1, NOR circuits NOR11 and NOR12 that receive the outputs of the shift register and polarity inverting circuit, inverters NOT11 to NOT15 that receive the outputs of the NOR circuits and serve as polarity inverters and buffers, timing signal lines TS1 to TS4 to receive timing signals from the inverters NOT11 to NOT15, video buses P1 to P12 and N1 to N12 (only some of them are shown in FIG. 15) for transmitting video signals supplied from the outside, and analog switches SWna to SWnx and SWpa to SWpx. Each of these analog switches has a gate connected to one of the timing signal lines TS1 to TS4 and a source connected to one of the video buses P1 to P12 and N1 to N12. These analog switches form p- and n-channel pairs with the drains of each pair being commonly connected to one of the signal lines S1 to S24. More precisely, the analog switches SWna and SWpa form a pair, the analog switches SWnb and SWpb form a pair, the analog switches SWnx and SWpx form a pair, and the like.

Figure 16:
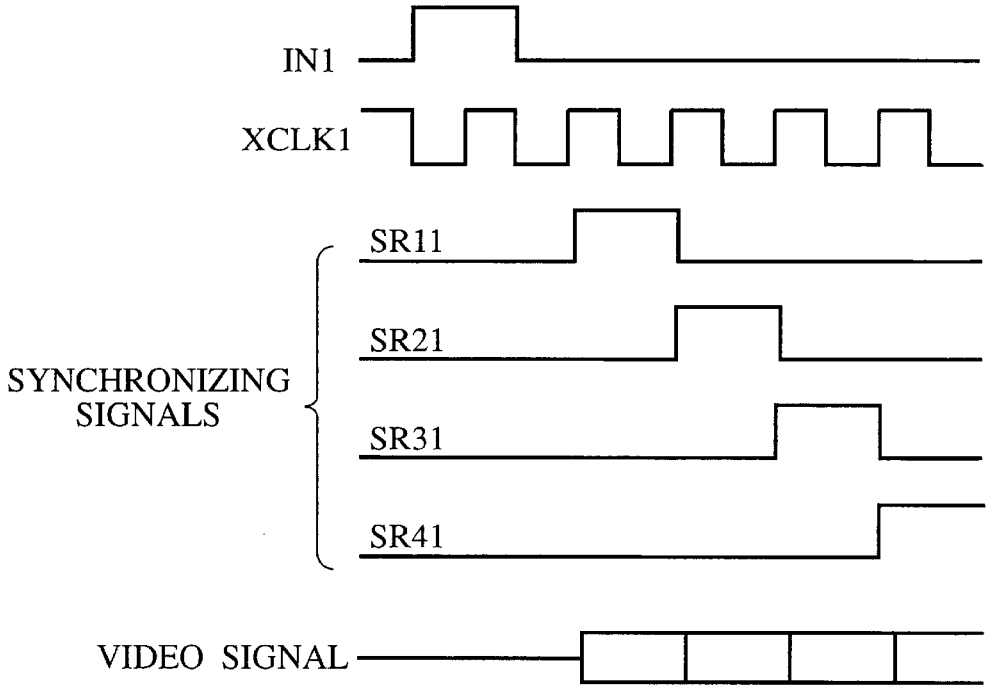
FIG. 16 is a time chart showing the operation of a signal driver of the embodiment 5.

FIG. 16 is a time chart showing the operation of the signal driver 240. A horizontal synchronizing signal IN1 and a horizontal clock signal XCLK1 (a horizontal clock signal XCLK2 is omitted because it is an inversion of XCLK1) are applied to the shift registers. The shift registers SR11, SR21, SR31, and SR41 (SR31 and SR41 are not shown in FIG. 15) sequentially provide synchronizing signals each rising to high level for a period of the clock signal. As a result, four synchronizing signals whose polarities are inverted frame by frame in response to a polarity inverting signal Vpol are supplied to the timing signal lines TS1 to TS4 from which the synchronizing signals are applied to the gate electrodes of the TFTs serving as the analog switches SWna to SWnx and SWpa to SWpx. In synchronization with the synchronizing signals, video signals are transmitted through the video buses P1 to P12 and N1 to N12 to the source electrodes of the TFTs serving as the analog switches SWna to SWnx and SWpa to SWpx. Namely, the source electrodes of the n-TFTs receive negative video signals, and the source electrodes of the p-TFTs receive positive video signals. Further, the gate electrodes of the n-TFTs receive positive synchronizing signals, and the gate electrodes of the p-TFTs receive negative synchronizing signals. Consequently, video signals whose polarities are inverted frame by frame in response to the polarity inverting signal Vpol are supplied to the signal lines S1 to S24.

Figure 2:
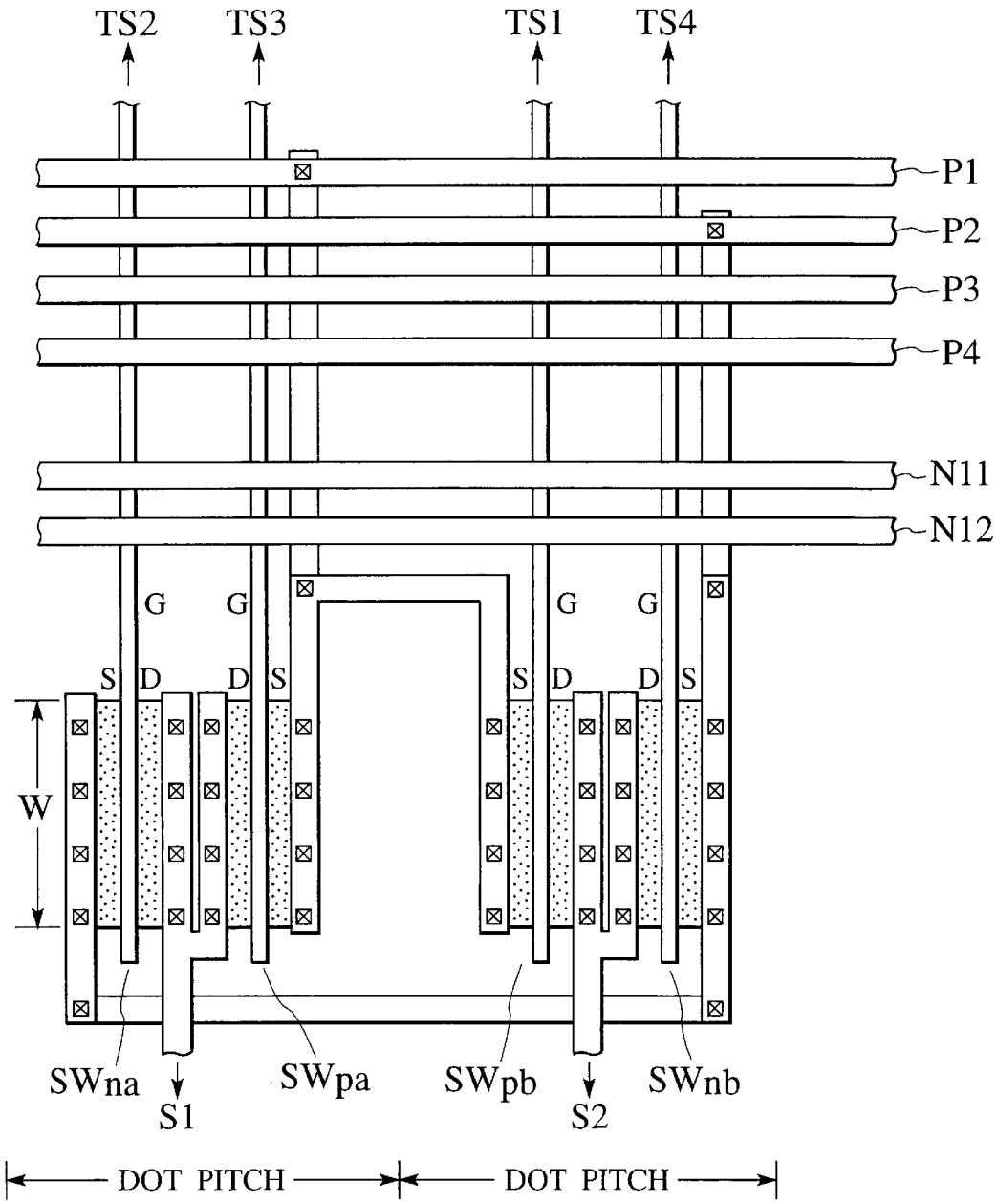
FIG. 2 shows a signal driver formed on an array substrate of the prior art of FIG. 1.
Figure 3A:
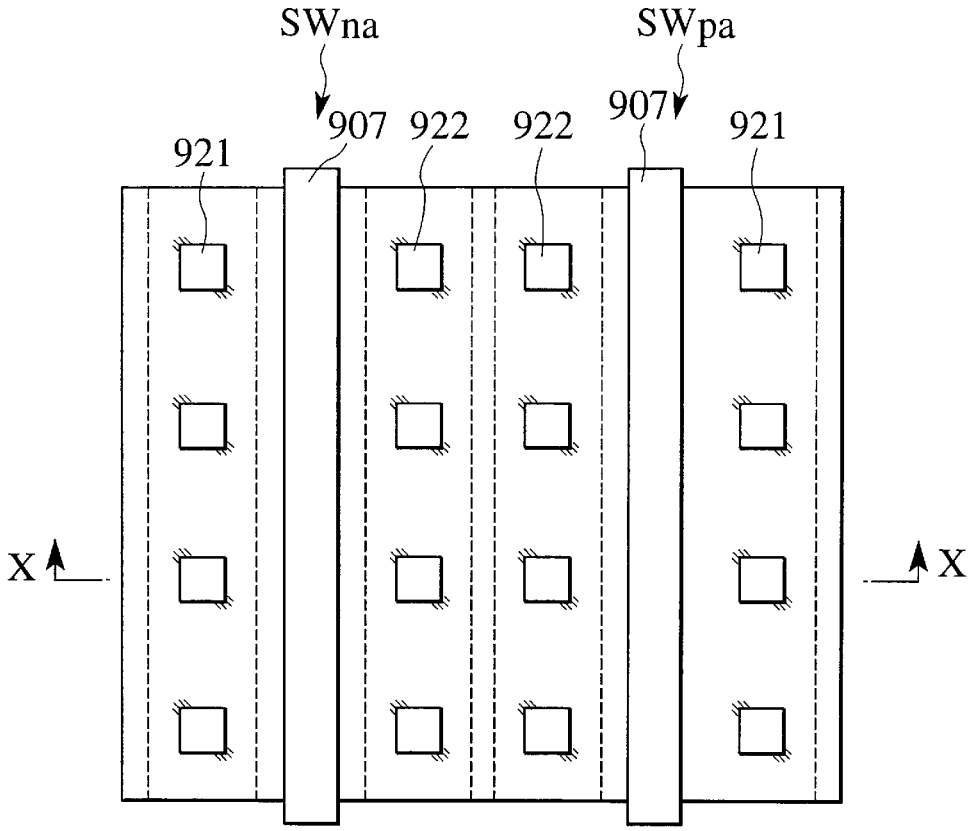
FIG. 3A is a plan view showing analog switches of the signal driver of FIG. 2.
Figure 3B:
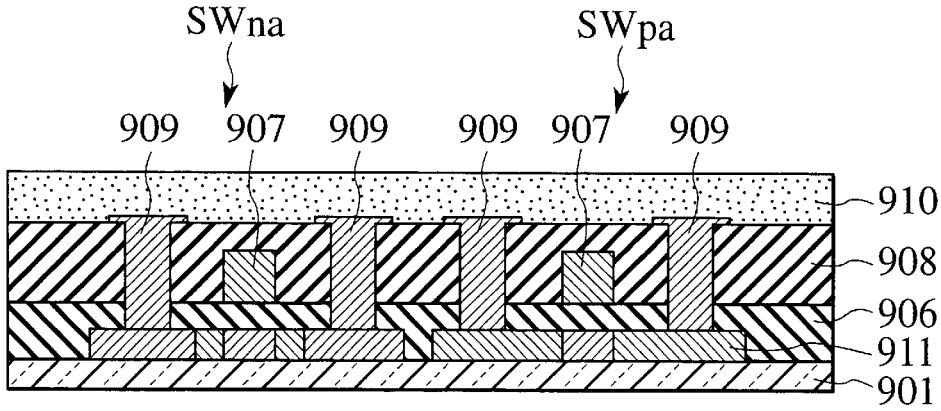
FIG. 3B is a sectional view showing the analog switches of FIG. 3A.
Figure 4:
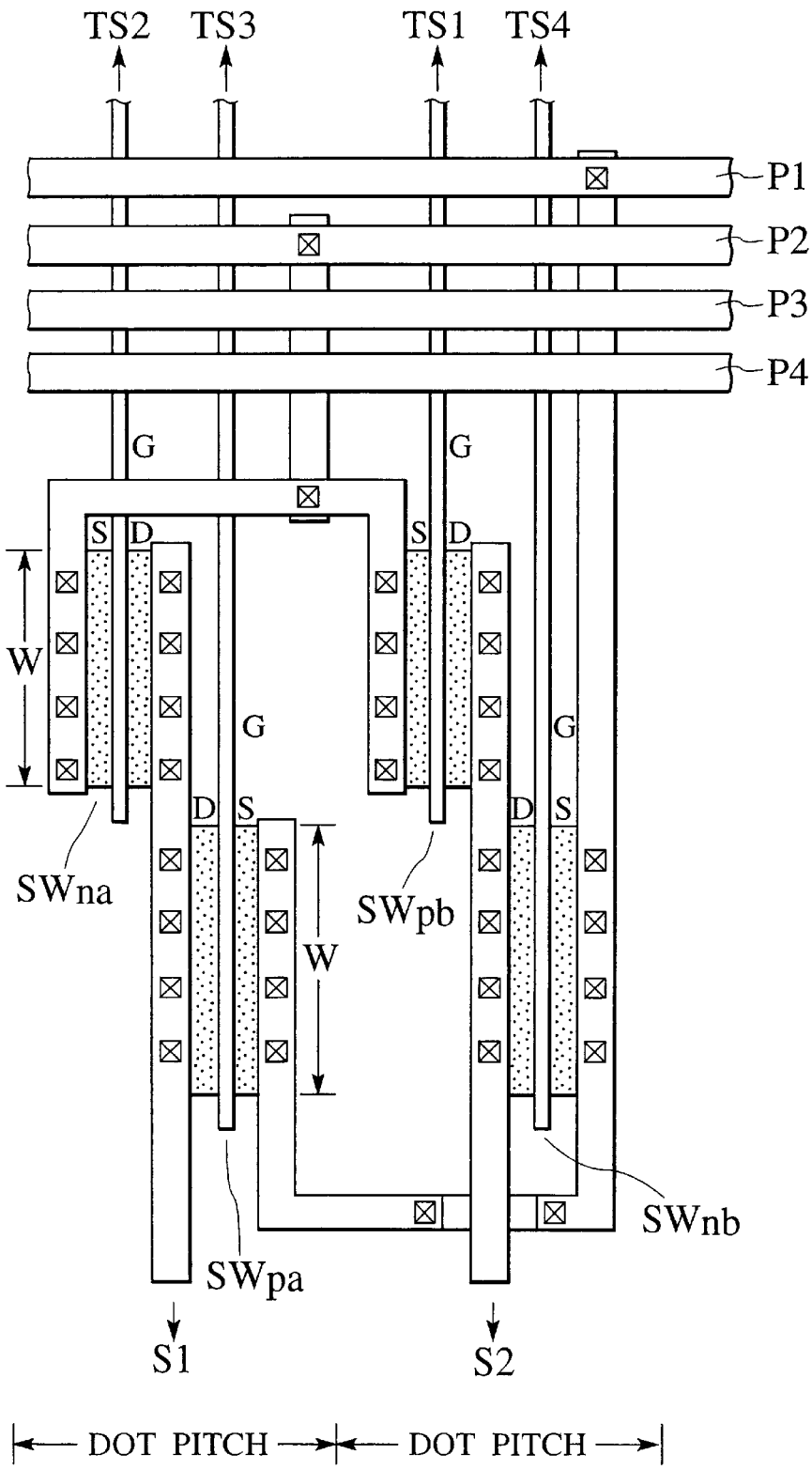
FIG. 4 shows a signal driver formed on an array substrate of an LCD according to another prior art.
Figure 17:
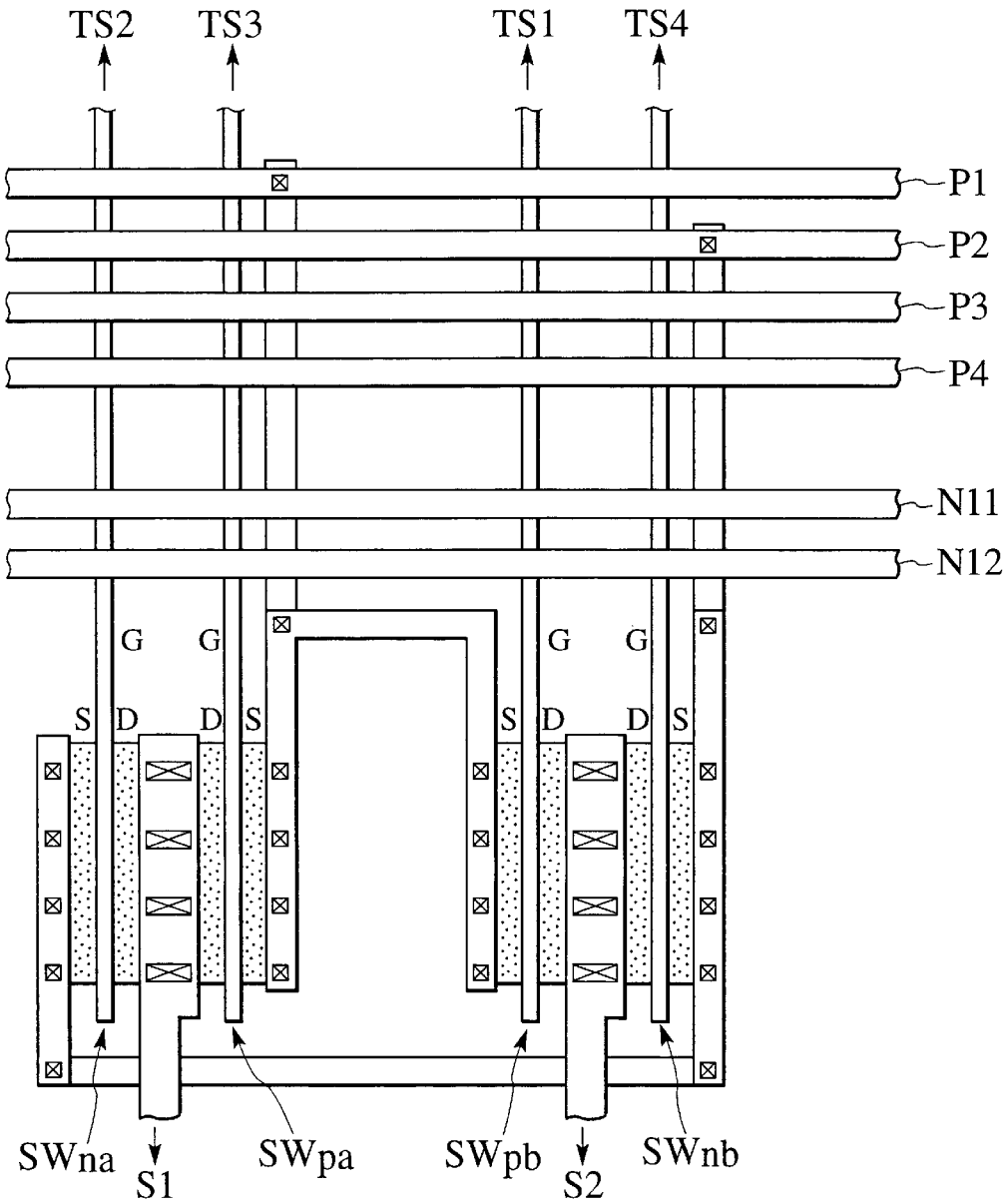
FIG. 17 is an enlarged view showing analog switches connected to signal lines of FIG. 15.

FIG. 17 is an enlarged view showing the analog switches connected to the signal lines S1 and S2 of FIG. 15. The same parts as those of FIG. 2 are represented with like reference marks and the explanation of the parts is omitted.

The embodiment 5 joins the drains of each pair of n- and p-TFTs serving as the analog switch pair SWna and SWpa, the analog switch pair SWnb and SWpb, the analog switch pair SWnx and SWpx, and the like. The joined drain regions have common contact holes that are connected to one of the signal lines S1 to S24.

Figure 18A:
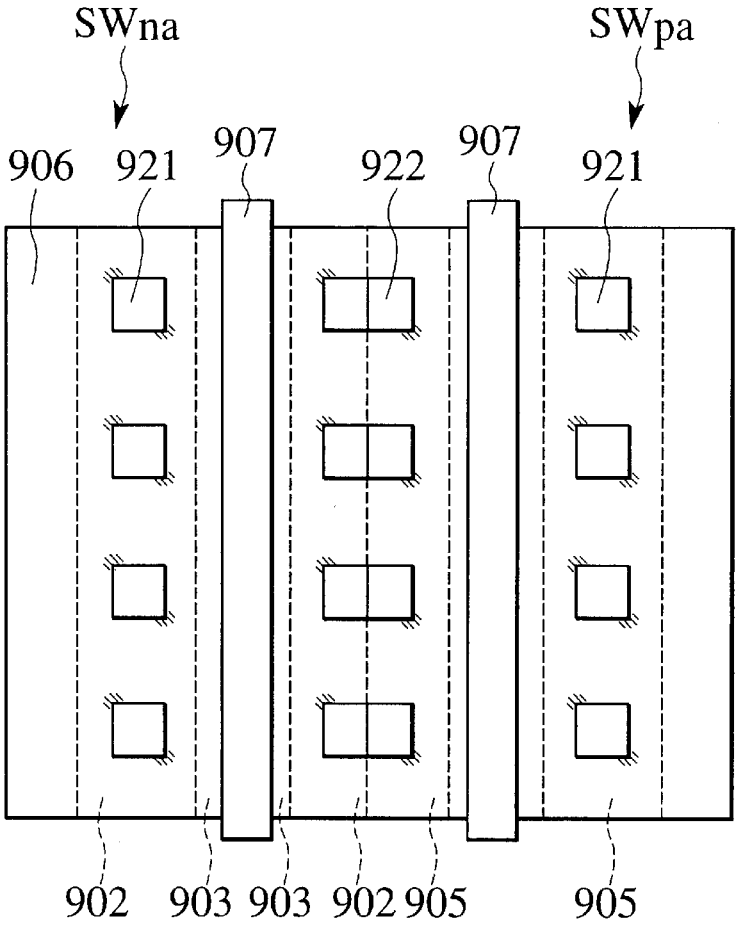
FIG. 18A is a plan view showing the drain regions of n- and p-TFTs serving as analog switches SWna and SWnb of the embodiment 5.
Figure 18B:
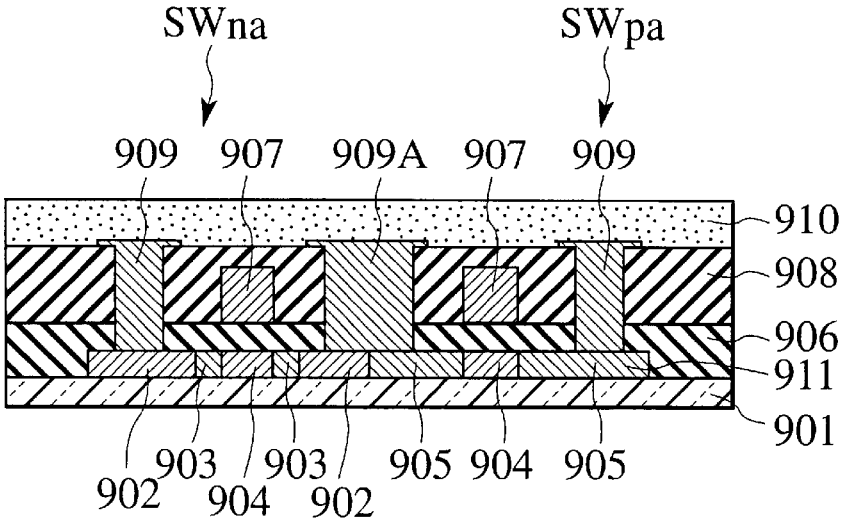
FIG. 18B is a sectional view showing the drain regions of FIG. 18A.

FIGS. 18A and 18B are plan and sectional views showing the details of the drain regions of the n- and p-TFTs serving as the analog switches SWna and SWnb. FIG. 18A specifically shows the contact holes by removing some top elements of FIG. 18B on the counter substrate side. In FIGS. 18A and 18B, there are a substrate 901, an active layer 911, a gate insulating film 906, an interlayer insulating film 908, a passivation film 910, gate electrodes 907, source electrodes 909, and drain electrodes 909A. FIG. 18A shows the shapes and arrangements of contact holes 921 for the source electrodes 909 and contact holes 922 for the drain electrodes 909A. The contact holes 921 and 922 are arranged in a gate width direction.

The contact hole 922 is twice as long as the contact hole 921 in a lateral direction as shown in FIG. 18A. The contact hole 922 equally covers the drain region, i.e., n region 902 of the n-TFT serving as the analog switch SWna and the drain region, i.e., p region 905 of the p-TFT serving as the analog switch SWpa. The contact hole 921 receives the source electrode 909, and the contact hole 922 receives the drain electrode 909A.

This arrangement is capable of reducing the width of each analog switch pair. For example, the analog switches can be arranged at dot pitches of about 55 $\mu$m without enlarging a frame area where the signal driver is formed.

Manufacturing processes of essential components of the embodiment 5 of FIGS. 18A and 18B will be explained.

A glass substrate 901 having undercoats of $SiO_2$ and SiNx is prepared. On the glass substrate 901, an amorphous S1 film is formed by CVD (chemical vapor deposition) and is changed into polysilicon by excimer laser annealing. The polysilicon is patterned to form an active layer 911 for TFTs. A gate insulating film 906 is formed over the substrate 901 by CVD. On the gate insulating film 906, an MoW film is formed. The MoW film is patterned to form a gate electrode 907 for each TFT. An interlayer insulating film 908 is formed by CVD, and contact holes 921 and 922 are opened.

Mo, Al, and Mo films are formed in this order to provide a three-layer structure. The three-layer structure is patterned to form source electrodes 909 and drain electrodes 909A. Then, a passivation film 910 is formed. At this time, the active layer 911 has impurities implanted by ion doping. The product includes an n-region 902, an LDD (lightly doped drain) region 903 for preventing the lowering of an ON current, an intrinsic semiconductor region 904, and a p-region 905. The n-region 902 and p-region 905 that are adjacent to each other at the center of FIG. 18B are drain regions connected to wiring that is connected to a signal line. The contact holes 922 are shared by the n-region 902 and p-region 905.

In this way, the embodiment 5 joins the drain regions of a pair of n- and p-TFTs serving as an analog switch pair, forms contact holes that cover the drain regions, and connects the drain regions to a signal line, to form a liquid crystal display panel.

[Embodiment 6]

Figure 19:
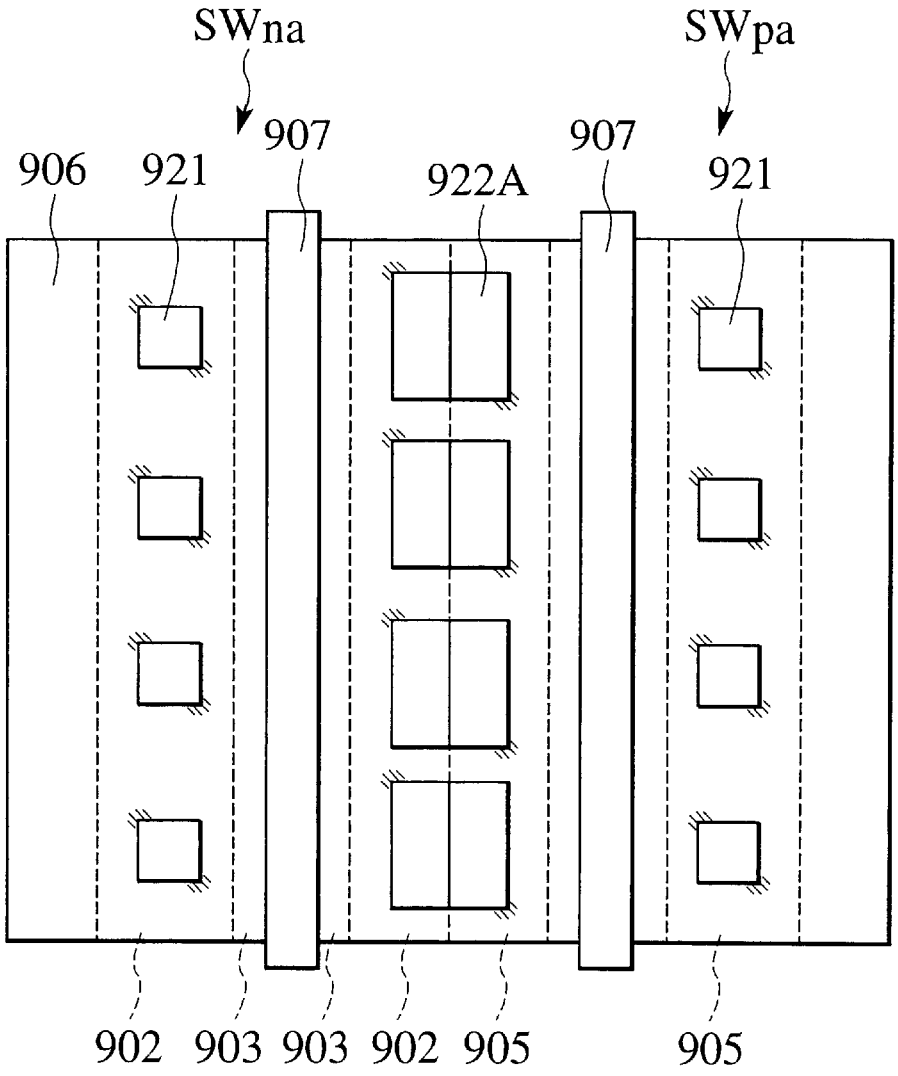
FIG. 19 is a plan view showing TFT switches of a TFT-LCD according to embodiment 6 of the present invention.

FIG. 19 is a plan view showing TFT switches of a TFT-LCD according to the embodiment 6 of the present invention. The details of the drain regions of n- and p-TFTs serving as analog switches SWna and SWpa are shown. This figure specifically shows contact holes in a manufacturing step. A sectional view for FIG. 19 is omitted because it is equal to FIG. 18B.

An n-region 902 and a p-region 905 are formed side by side. If a contact hole extending over the drain regions 902 and 905 is equal to a contact hole on a source region, drain contact resistance will be larger than source contact resistance in each of the n- and p-TFTs, to decrease the electron mobility of the TFTs. To secure electron mobility, the embodiment 6 enlarges a contact hole 922A extending over the n- and p-regions (drain regions) 902 and 905 at least twice as large as a contact hole 921 in a source region.

The embodiment 6 realizes high resolution without enlarging a frame area and secures electron mobility.

[Embodiment 7]

Figure 20A:
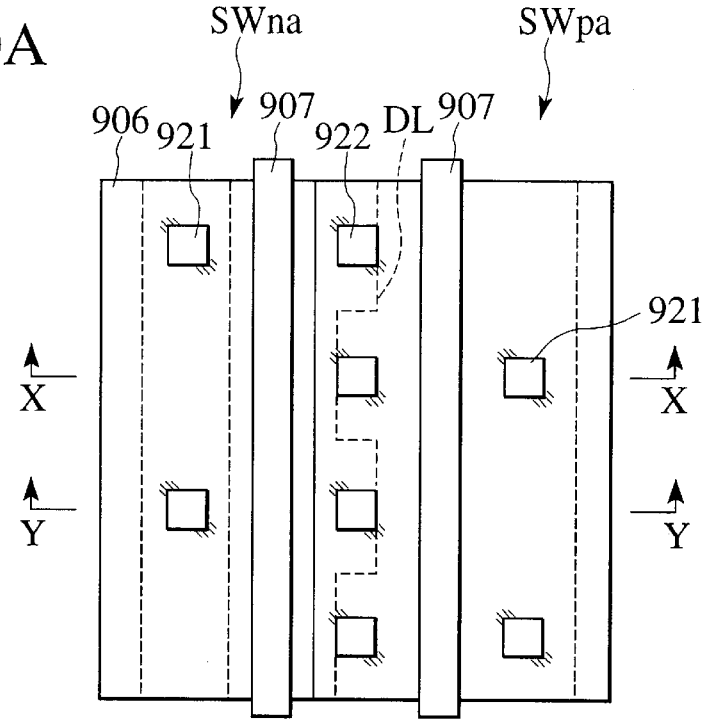
FIG. 20A is a plan view showing TFT switches of a TFT-LCD according to embodiment 7 of the present invention.
Figure 20B:
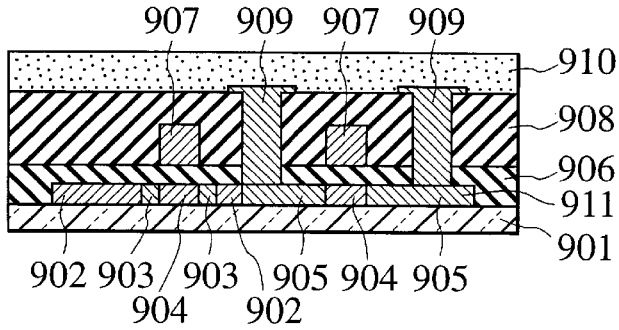
FIG. 20B is a sectional view taken along a line X—X of FIG. 20A.
Figure 20C:
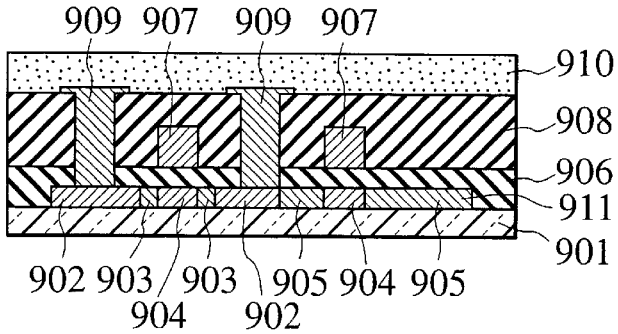
FIG. 20C is a sectional view taken along a line Y—Y of FIG. 20A.

FIGS. 20A, 20B, and 20C are plan and sectional views showing TFT switches of a TFT-LCD according to the embodiment 7 of the present invention. FIG. 20A removes the tops of the sectional views of FIGS. 20B and 20C, i.e., some elements on the counter substrate side, to specifically show contact holes in a manufacturing step. FIG. 20B is a sectional view taken along a line X—X of FIG. 20A, and FIG. 20C is a sectional view taken along a line Y—Y of FIG. 20A. Through these figures, the same parts as those of FIG. 18 are represented with like reference marks and the explanation thereof is omitted.

The drain region of an n-TFT serving as an analog switch SWna and the drain region of a p-TFT serving as an analog switch SWpa have toothed areas, respectively. These toothed areas mesh with each other as indicated with a dashed line DL in FIG. 20A. A contact hole 922 is formed on each protruding tooth of the toothed areas, and the contact holes 922 are connected to a signal line. In FIG. 20A, the n-TFT has two protruding teeth, and the p-TFT has two protruding teeth. Accordingly, an area where the drains of the TFTs are adjacent to each other involves four contact holes 922. Corresponding to the two contact holes 922 of its own, the n-TFT has two contact holes 921 on the source region thereof. Corresponding to the two contact holes 922 of its own, the p-TFT has two contact holes 921 on the source region thereof.

Compared with the embodiments of FIGS. 18 and 19, the embodiment 7 may slightly decrease electron mobility. However, the embodiment 7 needs only a single straight wire to be connected to a signal line.

In this way, the embodiment 7 arranges the contact holes 922 substantially in a straight line, to realize high resolution without increasing a frame area. The embodiment 7 employs toothed drain regions so that adjacent drain regions may mesh with each other, to reduce the total width of a drain region narrower than the embodiments 5 and 6. As a result, the embodiment 7 can further reduce dot pitches.

[Embodiment 8]

Figure 21:
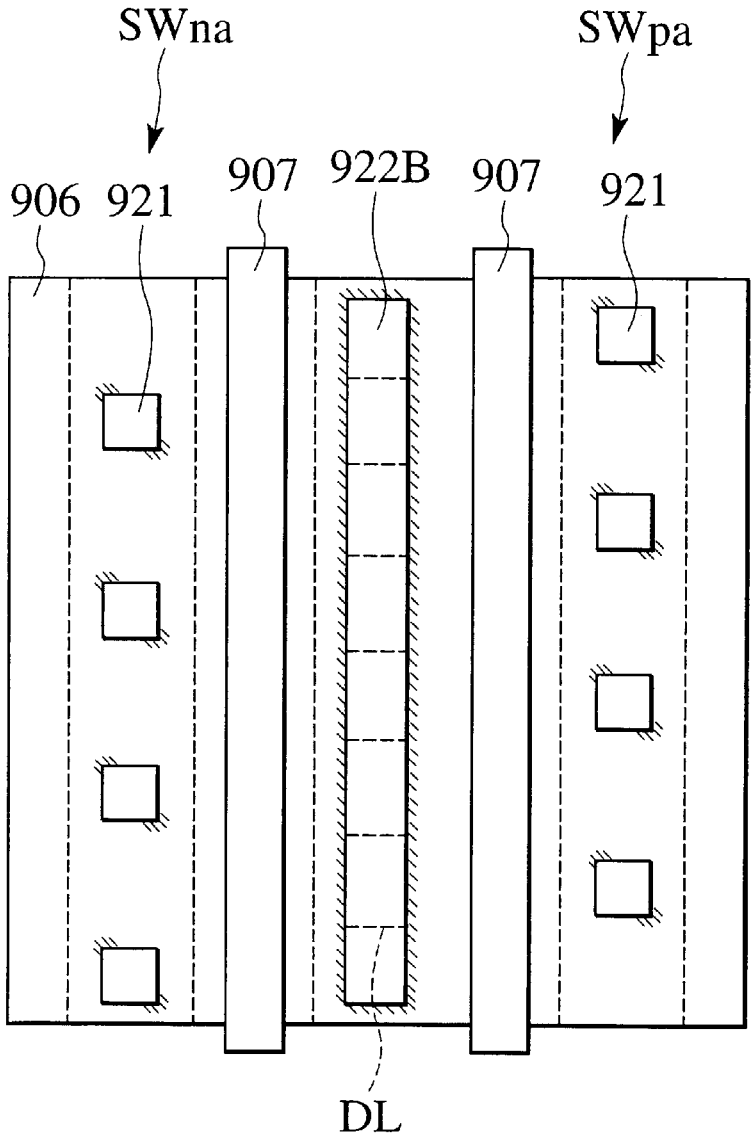
FIG. 21 is a plan view showing TFT switches of a TFT-LCD according to embodiment 8 of the present invention.

FIG. 21 is a plan view showing TFT switches of a TFT-LCD according to the embodiment 8. This figure specifically shows contact holes in one manufacturing process. Sectional views for FIG. 21 are equal to FIGS. 20B and 20C, and therefore, are omitted.

As explained above, the embodiment 7 forms four contact holes 922 in a gate width direction, and due to this, slightly decreases electron mobility. To avoid this, the embodiment 8 halves the width of each tooth to double the number of teeth meshing with each other in a gate width direction. In addition, the embodiment 8 forms a groove-like contact hole 922B to extend over the teeth. The embodiment 8 forms four contact holes 921 in the gate width direction on each source region.

In addition to the effect of the embodiment 7, the embodiment 8 secures electron mobility and simplifies semiconductor patterns to manufacture.

[Embodiment 9]

The embodiments 1 to 4 and the embodiments 5 to 8 may be combined in various ways. For example, each pair of p- and n-TFTs serving as an analog switch pair may have common drain contact holes, and at the same time, adjacent two n-TFTs may have common source contact holes. This further reduces a lateral width compared with conventional structures.

What is claimed is:

1. A liquid crystal display comprising:

a display panel;

a signal driver configured to supply video signals to signal lines;

a scan driver configured to supply scan signals to scan lines that intersect the signal lines; and an external driver configured to drive the signal and scan drivers, wherein:

the display panel has an array substrate, a counter substrate, and a liquid crystal layer held between the array substrate and the counter substrate, the array substrate has the signal and scan lines, pixel switching elements formed at corresponding intersections of the signal and scan lines, respectively, and pixel electrodes connected to the pixel switching elements, respectively, the counter substrate has counter electrodes that face the pixel electrodes, respectively, the signal driver has positive video buses for transmitting positive video signals, negative video buses for transmitting negative video signals, p-TFT switches each connected to one of the positive video buses through wiring, and n-TFT switches each connected to one of the negative video buses through wiring, the p-TFT and n-TFT switches are driven to selectively transmit the positive and negative video signals to the pixel switching elements, and among the p-TFT and n-TFT switches, adjacent P-TFT and n-TFT switches form a switch pair and are connected to one of the signal lines, and a p-TFT switch connected to a "2N−1"th (N being a natural number) one of the signal lines and a p-TFT switch connected to a "2N"th one of the signal lines have source electrodes connected to a common contact hole that is connected to one of the positive video buses.

2. The liquid crystal display of claim 1, wherein:

a source electrode of an n-TFT switch connected to a "2N"th one of the signal lines and a source electrode of an n-TFT switch connected to a "2N+1"th one of the signal lines are connected to a common contact hole that is connected to one of the negative video buses.

3. A liquid crystal display comprising;

a display panel;

a signal driver configured to supply video signals to signal lines;

scan driver configured to supply scan signals to scan lines that intersect the signal lines; and an external driver configured to drive the signal and scan drivers, wherein:

the display panel has an array substrate, a counter substrate, and a liquid crystal layer held between the array substrate and the counter substrate, the array substrate has the signal and scan lines, pixel switching elements formed at corresponding intersections of the signal and scan lines, respectively, and pixel electrodes connected to the pixel switching elements, respectively, the counter substrate has counter electrodes that face the pixel electrodes, respectively, the signal driver has positive video buses for transmitting positive video signals, negative video buses for transmitting negative video signals, p-TFT switches each connected to one of the positive video buses through wiring, and n-TFT switches each connected to one of the negative video buses through wiring, the p-TFT and n-TFT switches are driven to selectively transmit the positive and negative video signals to the pixel switching elements, and among the p-TFT and n-TFT switches, adjacent p-TFT and n-TFT switches form a switch pair and are connected to one of the signal lines, and an n-TFT switch connected to a "2N−1"th (N being a natural number) one of the signal lines and an n-TFT switch connected to a "2N"th one of the signal lines have source electrodes connected to a common contact hole that is connected to one of the negative video buses.

4. The liquid crystal display of claim 3, wherein:

a source electrode of a p-TFT switch connected to a "2N"th one of the signal lines and a source electrode of a p-TFT switch connected to a "2N+1"th one of the signal lines are connected to a common contact hole that is connected to one of the positive video buses.

5. A liquid crystal display comprising:

a display panel;

a signal driver configured to supply video signals to signal lines;

a scan driver configured to supply scan signals to scan lines that intersect the signal lines; and an external driver configured to drive the signal and scan drivers, wherein:

the display panel has an array substrate, a counter substrate, and a liquid crystal layer held between the array substrate and the counter substrate, the array substrate has the signal and scan lines, pixel switching elements formed at corresponding intersections of the signal and scan lines, respectively, and pixel electrodes connected to the pixel switching elements, respectively, the counter substrate has counter electrodes that face the pixel electrodes, respectively, the signal driver has positive video buses for transmitting positive video signals, negative video buses for transmitting negative video signals, p-TFT switches each connected to one of the positive video buses through wiring, and n-TFT switches each connected to one of the negative video buses through wiring, the p-TFT and n-TFT switches are driven to selectively transmit the positive and negative video signals to the pixel switching elements, and adjacent p-TFT and n-TFT switches among the p-TFT and n-TFT switches form a switch pair and have drain electrodes that are adjacent to each other and are connected to one of the signal lines through a common contact hole extending over the drain electrodes.

6. The liquid crystal display of claim 5, wherein:

the common contact hole for the drain electrodes of each switch pair is at least twice as large as each of contact holes for connecting the source electrodes of the switch pair to the video buses.

7. A liquid crystal display comprising:

a display panel;

a signal driver configured to supply video signals to signal lines;

a scan driver configured to supply scan signals to scan lines that intersect the signal lines; and an external driver configured to drive the signal and scan drivers, wherein:

the display panel has an array substrate, a counter substrate, and a liquid crystal layer held between the array substrate and the counter substrate, the array substrate has the signal and scan lines, pixel switching elements formed at corresponding intersections of the signal and scan lines, respectively, and pixel electrodes connected to the pixel switching elements, respectively, the counter substrate has counter electrodes that face the pixel electrodes, respectively, the signal driver has positive video buses for transmitting positive video signals, negative video buses for transmitting negative video signals, p-TFT switches each connected to one of the positive video buses through wiring, and n-TFT switches each connected to one of the negative video buses through wiring, the p-TFT and n-TFT switches are driven to selectively transmit the positive and negative video signals to the pixel switching elements, and adjacent p-TFT and n-TFT switches among the p-TFT and n-TFT switches form a switch pair, each switch pair having drain electrodes that have toothed areas, respectively, and the toothed areas of each switch pair mesh with each other and are connected to one of the signal lines through contact holes each formed on a protruding tooth of the meshing toothed areas.

8. The liquid crystal display of claim 7, wherein:

the contact holes on the meshing toothed areas of each switch pair are consecutive to form a groove.

* * * * *